US008966668B2

(12) United States Patent
Sutton

(10) Patent No.: US 8,966,668 B2
(45) Date of Patent: Mar. 3, 2015

(54) WEB AND BLADDER SUSPENSION PROTECTION SYSTEM

(71) Applicant: Andrew Cameron Sutton, Corona del Mar, CA (US)

(72) Inventor: Andrew Cameron Sutton, Corona del Mar, CA (US)

( * ) Notice: Subject to any disclaimer, the term of this patent is extended or adjusted under 35 U.S.C. 154(b) by 0 days.

(21) Appl. No.: 14/103,654

(22) Filed: Dec. 11, 2013

(65) Prior Publication Data

US 2014/0359912 A1 Dec. 11, 2014

Related U.S. Application Data

(63) Continuation-in-part of application No. 13/722,001, filed on Dec. 20, 2012, now abandoned.

(60) Provisional application No. 61/736,281, filed on Dec. 12, 2012, provisional application No. 61/802,604, filed on Mar. 16, 2013, provisional application No. 61/843,839, filed on Jul. 8, 2013, provisional application No. 61/630,969, filed on Dec. 20, 2011.

(51) Int. Cl.
*A41D 27/12* (2006.01)
*A41D 27/26* (2006.01)
(Continued)

(52) U.S. Cl.
CPC ..... *A63B 71/1225* (2013.01); *A41D 13/015* (2013.01); *A41D 13/065* (2013.01); *A41D 13/08* (2013.01); *A63B 71/14* (2013.01); *A63B 2071/125* (2013.01)
USPC ..... 2/267; 2/2.5; 2/455

(58) Field of Classification Search
CPC ..... A41D 13/015; A41D 13/0518; A41D 13/0506; A41D 31/0044; A41D 13/05; A41D 13/0593; A41D 31/005; A41D 13/065; A41D 19/01523; A41D 13/0512; A41D 31/0061; A41D 13/0537; A41D 13/012; A41D 13/0543; A41D 13/06; A41D 13/1254; A41D 19/001; A41D 31/0055; A41D 13/0015; A41D 27/12; A41D 13/00; A41D 13/0002; A41D 13/0155; A41D 13/08; A41D 13/018; A41D 31/0011; A41D 13/1236; A41D 27/00; A41D 27/04; A41D 27/02; A63B 71/12; A63B 71/08; A63B 2071/1208; A63B 2071/1233; A63B 71/081; A63B 71/1225; A63B 2071/1258; A63B 71/10; A63B 2071/125; A63B 2071/1241; A63B 2243/0025; A63B 2243/0004; A63B 2243/0041; A63B 2244/19; A63B 59/0092; A63B 2209/00; A63B 53/08; A63B 59/0059; F41H 5/0478; F41H 1/00; F16F 7/00; F16F 13/00; F16F 9/53; F16F 5/00; F16F 9/003; F16F 9/006; F16F 9/10; F16F 1/3737; F16F 3/0873; A42B 3/121; A42B 3/12; A42B 3/122; A42B 3/063; A42B 3/065; A42B 3/128; A42B 1/08; A42B 3/127; A43B 13/203; A43B 17/035; A43B 7/32; A43B 13/206; A43B 17/003; A43B 5/0407; A43B 13/189; A43B 1/00; A43B 21/265; A43B 13/04; A43B 21/285; A43B 13/40; A43B 13/386; A43B 5/0405; Y10S 2/03; Y10S 206/804; B32B 2307/56; B32B 3/20; B32B 3/22; B32B 2571/00; B32B 5/245; B32B 2437/00; B32B 25/00; B32B 2250/40; B29L 2031/48; B29L 2031/4821; B29L 2031/768; B65D 81/052; B65D 81/03
USPC ..... 2/24, 22, 16, 455, 911, 413, 908, 2/DIG. 3, DIG. 10
See application file for complete search history.

(56) References Cited

U.S. PATENT DOCUMENTS 871,760 A * 11/1907 Long ..... 2/24
1,726,939 A * 9/1929 Anderson ..... 267/117
(Continued)

*Primary Examiner* — Bobby Muromoto, Jr.
(74) *Attorney, Agent, or Firm* — Plager Schack LLP; Vito A. Canuso, III

(57) ABSTRACT

Lightweight and flexible personal protective padding systems for the protection of joints, bones and muscles, where one embodiment includes a hard outer shell structure as shielding, a gas filled compartment or bladder to stabilize the system and absorb and disperse impact energy and/or a web structure suspended across opposed peripheral edges of the outer shell and between the shell and user's body to absorb energy and to provide ventilation. Hybrid structures include both the bladder and web structure.

5 Claims, 42 Drawing Sheets

(51) Int. Cl.

| | |
|---|---|
| ***A63B 71/12*** | (2006.01) |
| ***A41D 13/015*** | (2006.01) |
| ***A41D 13/06*** | (2006.01) |
| ***A41D 13/08*** | (2006.01) |
| ***A63B 71/14*** | (2006.01) |
| *F41H 5/08* | (2006.01) |

(56) References Cited

U.S. PATENT DOCUMENTS

| | | | | | |
|---|---|---|---|---|---|
| 2,491,557 | A | * | 12/1949 | Goolsbee | 5/236.1 |
| 2,618,780 | A | * | 11/1952 | Cushman | 2/413 |
| 2,664,567 | A | * | 1/1954 | Nichols | 2/413 |
| 2,672,183 | A | * | 3/1954 | Forsyth | 297/452.48 |
| 2,694,395 | A | * | 11/1954 | Brown | 601/151 |
| 2,814,053 | A | * | 11/1957 | Sevcik | 5/710 |
| 3,153,413 | A | * | 10/1964 | Gottfried | 602/60 |
| 3,171,410 | A | * | 3/1965 | Towle, Jr. et al. | 602/53 |
| 3,407,406 | A | * | 10/1968 | Werner et al. | 2/413 |
| 3,425,061 | A | * | 2/1969 | Webb | 2/414 |
| 3,462,778 | A | * | 8/1969 | Whitney | 5/713 |
| 3,784,985 | A | * | 1/1974 | Conroy | 2/22 |
| 3,872,511 | A | * | 3/1975 | Nichols | 2/413 |
| 3,877,076 | A | * | 4/1975 | Summers et al. | 2/414 |
| 3,879,776 | A | * | 4/1975 | Solen | 5/665 |
| 3,968,530 | A | * | 7/1976 | Dyson | 5/676 |
| 3,992,238 | A | * | 11/1976 | Johns | 156/93 |
| 3,999,220 | A | * | 12/1976 | Keltner | 2/413 |
| 4,067,063 | A | * | 1/1978 | Ettinger | 2/413 |
| 4,075,717 | A | * | 2/1978 | Lemelson | 2/412 |
| 4,083,127 | A | * | 4/1978 | Hanson | 36/93 |
| 4,124,904 | A | * | 11/1978 | Matthes | 2/413 |
| 4,129,951 | A | * | 12/1978 | Petrosky | 36/29 |
| 4,144,658 | A | * | 3/1979 | Swan, Jr. | 36/117.6 |
| 4,149,541 | A | * | 4/1979 | Gammons et al. | 607/104 |
| 4,175,297 | A | * | 11/1979 | Robbins et al. | 5/284 |
| 4,229,889 | A | * | 10/1980 | Petrosky | 36/28 |
| 4,247,963 | A | * | 2/1981 | Reddi | 5/687 |
| 4,319,412 | A | * | 3/1982 | Muller et al. | 36/29 |
| 4,442,834 | A | * | 4/1984 | Tucker et al. | 602/13 |
| 4,485,505 | A | * | 12/1984 | Paul | 5/714 |
| 4,542,547 | A | * | 9/1985 | Sato | 5/713 |
| 5,679,197 | A | * | 10/1997 | Haupt et al. | 156/212 |
| 5,687,426 | A | * | 11/1997 | Sperber | 2/411 |
| 5,749,111 | A | * | 5/1998 | Pearce | 5/652 |
| 5,764,164 | A | * | 6/1998 | Cartabiano et al. | 341/22 |
| 6,230,501 | B1 | * | 5/2001 | Bailey et al. | 62/51.1 |
| 6,253,376 | B1 | * | 7/2001 | Ritter | 2/24 |
| 6,557,272 | B2 | * | 5/2003 | Pavone | 36/29 |
| 7,661,148 | B2 | * | 2/2010 | Landi et al. | 2/24 |
| 7,661,164 | B2 | * | 2/2010 | Chen | 5/655.5 |
| 7,665,159 | B2 | * | 2/2010 | Fowkes | 4/581 |
| 7,669,936 | B2 | * | 3/2010 | Aubriet et al. | 297/452.56 |
| 7,676,960 | B2 | * | 3/2010 | DiBenedetto et al. | 36/132 |
| 7,676,961 | B2 | * | 3/2010 | DiBenedetto et al. | 36/132 |
| 7,681,264 | B2 | * | 3/2010 | Graebe | 5/653 |
| 7,682,680 | B2 | * | 3/2010 | McMahan | 428/76 |
| 7,691,084 | B2 | * | 4/2010 | Knighton et al. | 604/133 |
| 7,695,069 | B2 | * | 4/2010 | Prust | 297/452.45 |
| 7,708,708 | B2 | * | 5/2010 | Nordt et al. | 602/5 |
| 7,722,124 | B2 | * | 5/2010 | Peterson | 297/440.2 |
| 7,730,566 | B2 | * | 6/2010 | Flick et al. | 5/655.5 |
| 7,754,127 | B2 | * | 7/2010 | McMahan | 264/261 |
| 7,797,759 | B2 | * | 9/2010 | Cunningham | 2/24 |
| 7,832,017 | B2 | * | 11/2010 | Nascimento et al. | 2/22 |
| 7,841,019 | B2 | * | 11/2010 | Godshaw et al. | 2/24 |
| 7,845,017 | B2 | * | 12/2010 | Godshaw et al. | 2/24 |
| 7,882,568 | B2 | * | 2/2011 | Fee | 2/24 |
| 7,900,271 | B2 | * | 3/2011 | Sonner | 2/24 |
| 7,958,573 | B2 | * | 6/2011 | Lewis et al. | 2/414 |
| 7,976,924 | B2 | * | 7/2011 | Stanford et al. | 428/92 |
| 8,042,198 | B1 | * | 10/2011 | Cleveland | 2/411 |
| 8,105,129 | B2 | * | 1/2012 | Chen | 450/38 |
| 8,181,271 | B2 | * | 5/2012 | Sasaki et al. | 2/24 |
| 8,256,021 | B2 | * | 9/2012 | Nascimento et al. | 2/22 |
| 8,277,910 | B2 | * | 10/2012 | Koyanagi et al. | 428/35.7 |
| 8,353,062 | B2 | * | 1/2013 | Landi et al. | 2/24 |
| 8,458,820 | B2 | * | 6/2013 | Cleva | 2/413 |
| 8,479,314 | B2 | * | 7/2013 | Colanto et al. | 2/24 |
| 8,615,817 | B2 | * | 12/2013 | Phillips | 2/411 |
| 2002/0064319 | A1 | * | 5/2002 | Tanaka et al. | 383/3 |
| 2005/0229537 | A1 | * | 10/2005 | Koyanagi et al. | 53/133.2 |
| 2005/0244527 | A1 | * | 11/2005 | Koyanagi et al. | 425/5 |
| 2007/0006443 | A1 | * | 1/2007 | Koyanagi | 29/514 |

* cited by examiner

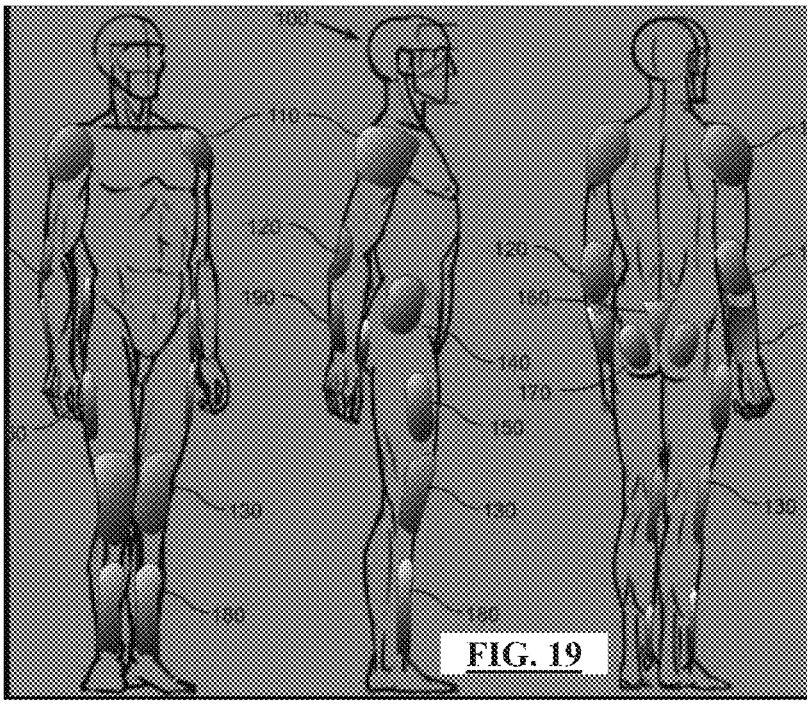

FIG. 19

| Comparing Material Properties To Injury Protection | Use-Specific Manufactured Materials and Assemblies | | | | | | |
|---|---|---|---|---|---|---|---|
| | 210 | 220 | 230 | | | | 240 |
| PROPERTY | Radial Impact | Change-state Gel | Layered Foam | Gel Cells | Air Bladder | Formable Rigid Foam | Rigid Composites |
| Flexibility | 8 | 6 | 10 | 6 | 6 | 2 | 0 |
| Durability | 8 | 6 | 2 | 6 | 4 | 4 | 10 |
| Impact Energy Dispersion | 8 | 8 | 4 | 6 | 4 | 6 | 10 |
| Modulus (Damping) | 6 | 6 | 2 | 4 | 4 | 4 | 8 |
| Toughness | 8 | 6 | 2 | 4 | 6 | 4 | 10 |
| Fatigue Resistance | 8 | 6 | 2 | 4 | 4 | 4 | 8 |
| Density | 6 | 6 | 2 | 6 | 2 | 6 | 8 |
| Ductility | 8 | 8 | 4 | 6 | 6 | 2 | 0 |
| Strength | 6 | 6 | 2 | 6 | 4 | 4 | 10 |
| Low Costs | 8 | 2 | 10 | 6 | 8 | 8 | 6 |
| Heat Dissipation | 6 | 6 | 2 | 0 | 0 | 2 | 4 |
| High Velocity Projectile Impact | 4 | 6 | 2 | 2 | 2 | 6 | 10 |
| Relative Rating (0=Poor; 10=Good) | | | | | | | |

FIG. 20

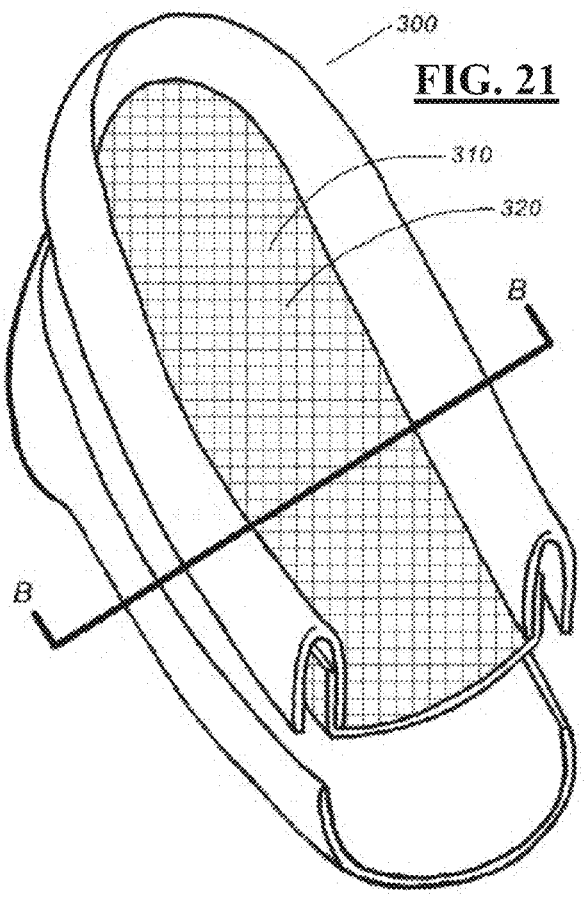
FIG. 21
FIG. 22
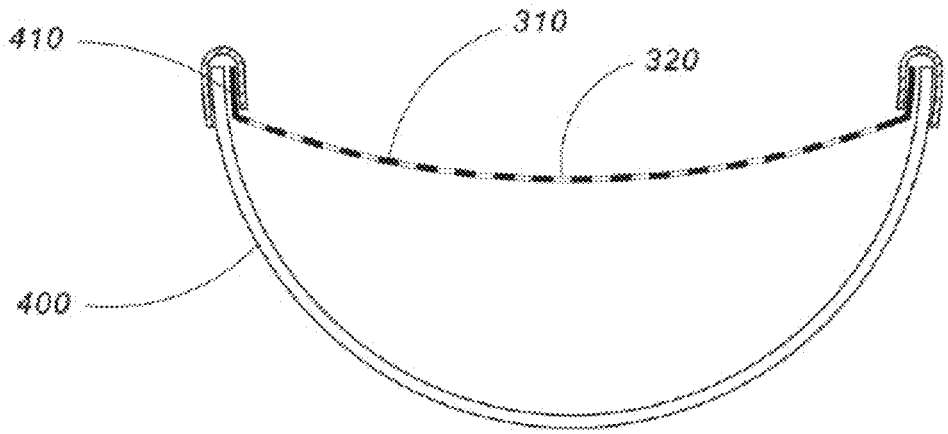

WEB AND BLADDER SUSPENSION PROTECTION SYSTEM

CROSS REFERENCE TO RELATED APPLICATIONS

The present application is a continuation-in-part and claims the priority benefits of non-provisional application U.S. Ser. No. 13/722,001, filed on Dec. 20, 2012, provisional application U.S. Ser. No. 61/630,969, filed on Dec. 20, 2011, provisional application U.S. Ser. No. 61/736,281, filed on Dec. 12, 2012, provisional application U.S. Ser. No. 61/802,604, filed on Mar. 16, 2013, and provisional application U.S. Ser. No. 61/843,839, filed on Jul. 8, 2013, all of which are incorporated in their entirety herein expressly and/or by reference.

FIELD OF INVENTION

The presently described inventions relate generally to personal protective padding systems for the protection of joints, bones and body parts from injury during engagement of an individual, preferably in impact environments of use, such as sporting events, including hockey, football, soccer and baseball for example and other environments such as construction, mining, military, law enforcement and the like, but without significantly limiting their body movements or causing fatigue.

BACKGROUND

Personal protective equipment is utilized to protect individuals from bodily injury in various applications such as, but not limited to, sports, work, law enforcement and military events. Protective equipment typically is used by various individuals during their engagement in the related activities. Examples of conventional protective equipment include elbow pads; knee pads; helmets; face masks; shoulder pads; gloves; shoes; thigh pads; neck rolls; hip pads; tailbone pads; rib pads; shin pads; forearm guards; wrist guards; abdomen guards; bullet resistant vests; protective vests; bomb suits; motorcycle armor and other protective equipment to be worn by an individual user. This conventional equipment typically includes an outer shield whose outer surface is the first part of the equipment to sustain the impact, and inner padding that is positioned under the shield, so that it is between the shield and the user. The purpose of personal protective equipment is to protect the body of the individual user from blunt impacts incurred from opponents and/or objects (e.g. hockey puck, baseball, projectile, hitting an opponent, etc.) or the individual user engaging an object (e.g. falling to a ground surface, hitting a wall, etc.).

Conventional protective equipment padding typically is typically constructed of synthetic materials such as foam rubbers, molded plastics or a combination of plastics, rubber and foam. Conventional shields are typically made of hard materials such as hard plastics, ceramics and metals. The protective equipment is formed into a desired shape to protect the appropriate body region. The protective equipment may be worn externally, internally or within of the clothing (e.g. uniform, jersey, pants, shirt) of an individual. For example, the protective equipment may be worn externally or internally of the clothing utilizing straps or fasteners. The protective equipment may also be inserted into compartments or related structures within the clothing. The protective equipment may also be manufactured so that the protective shield and padding is within and part of the clothing itself.

There are at least two problems with conventional protective equipment in that they are bulky and relatively inflexible. Another problem with conventional protective equipment is that they add a substantial amount of weight to a person, and which additional weight can cause fatigue over time during use. Another problem with conventional protective equipment is that the foam rubber material can collect fluids during use thereby further increasing the weight of the protective padding over time. Also, collection of sweat and residue on some of the protection systems, such as, for example, the foam lining of bicycle helmets, can degrade the integrity and protective capability of the foam padding.

Because of these inherent problems with conventional protective equipment, there is a need for new, improved, lightweight and flexible protective equipment systems that effectively protect a person from injury without significantly limiting their body movement, causing fatigue and/or breakdown of the protective nature of the padding over time.

SUMMARY

The presently described joint protection pad systems are specific applications of, include hybrids of and include improvements over the protective equipment, padding and systems described in utility patent application Ser. No. 13/722,001, filed Dec. 20, 2012, based upon U.S. provisional patent application 61/630,969, filed Dec. 20, 2011 and of U.S. provisional patent applications 61/736,281, filed Dec. 12, 2012, and 61/802,604, filed Mar. 16, 2013, all of which are incorporated by reference herein. Those applications are directed to protective systems that employ (i) an outer shell or shield and an inner, energy absorbing bladder system, (ii) an outer shell or shield and an inner air gap and an inner, energy absorbing suspension system, and (iii) combinations or hybrids of both the bladder and suspension systems. The presently described protection systems are directed to systems that may be included in garments and accessories that incorporate features of the bladder and suspension protective systems and are adapted for padded shirts; padded shorts; sliding shorts; padded girdles; shoulder injury shirts, goalie shorts; goalie shirts; shooter sleeves; hip, thigh and tailbone pad sets; batter elbow guards; batter shin guards; and forearm sleeves for various sports. These garments and accessories overcome the drawbacks of known limitations of the previous systems by providing customizable, lightweight systems of protection and energy-absorbing padding which do not significantly limit movement of the individual wearing the garment or accessory, do not cause fatigue at the rate of the previous padding systems and/or do not degrade over time while providing increased protection and a decrease in the concentration of observed force impacted upon the individual.

The systems described herein generally relate to personal protective equipment as described in several United States patent applications. For example, U.S. provisional patent application 61/736,281 includes a suspension system comprised of an outer shell with a flexible substrate which provides a noticeable gap between the player and the outer shell of the system. The noticeable gap may either remain as is, or have a bladder system inserted between the outer shell and the flexible substrate.

Also, the bladder systems as described herein generally relate to personal protective equipment as described in pending United States patent application Ser. No. 13/722,001, and U.S. provisional patent application 61/802,604, which include a bladder system comprised of a plurality of compartments, and that also may be referred to as bladders, containers, closed tubes or vessels filled with a gas (collectively sometimes referred to as "gas compartments" and in the singular as "gas compartment"). The gas compartments correspond to and are referred to as containers in U.S. Pat. No. 8,277,910, and the preferred gas compartments referred to herein are of the type described in the '910 patent. The gas compartments or containers are in fluid communication with each other, provided with a fill valve that includes a reverse flow check valve. The gas compartments may be of various lengths and are comprised of a first membrane and a second membrane, corresponding to membranes 60, 62 of application Ser. No. 13/722,001. The membrane material is capable of incurring significant impacts without rupturing. The most preferred material for the membranes is a 7-9-layer coextruded, low density polyethylene film with nylon strands incorporated within the membranes and which function to provide increased strength.

In the present application, the personal protective padding systems preferably comprise a hard outer shell, or shield with a bladder system comprised of gas compartments which are fashioned to form a stabilization bladder that preferably fully encompasses the user's body at the position of likely blunt force impact to the joint being. The systems also preferably provide further protection to the user by a flexible substrate or web which is positioned against the user and is secured to the hard, outer shell.

The stabilization bladders are customizable in that they can be inflated or filled to different degrees of pressure which is chosen by the user to allow for a personalized level of protection, depending on the application. The stabilization bladder allows essentially full mobility of the joint being protected by allowing the joint protection padding system to freely move with the user's joint and adjacent bones and muscle, while reducing the impact of any blow to the joint or bone(s) and muscle(s) being protected. The gas compartments and valving combine to form a joint stabilization bladder, and the bladder and shield combine to form the joint protection padding system.

The above summarized features of the personal protective padding systems are provided in order that the detailed description thereof may be better understood, and in order that the advantages of the present systems may be better appreciated. Additional features and embodiments of the systems will be described hereinafter and will form the inventive subject matter supporting the claims appended hereto. In this respect, before explaining at least one embodiment of the invention in detail, it is to be understood that the systems are not limited in application to the details of construction or to the arrangements of the components set forth in the following description or illustrated in the drawings. Rather, the systems may be practiced in numerous forms and embodiments, and of being practiced and carried out in various ways, all within the scope of the present inventions. Also, it is to be understood that the phraseology and terminology employed herein are for the purpose of the description and should not be regarded as limiting.

In one embodiment, a personal protective padding system is provided for protection of a user from blunt force impact to a corresponding joint of the user's body, where the padding system comprises (a) a first and a second outer shield member, each outer shield member having a front face and a rear face, the first and second outer shield members movably fastened together so as to reduce limiting movement of the user's body parts adjacent to each side of the joint to which the system is applied; (b) a plurality of inflated gas compartments, a first set positioned adjacent the rear face of the first outer shield member and a second set positioned adjacent the rear face of the second outer shield member, each set of gas compartments configured to absorb and diffuse impact energy when the system is applied to a corresponding joint, each set of the gas compartments comprising a multi-layered, coextruded polyethylene film, the film comprising reinforcing strands incorporated therein; and (c) a flexible, polymeric web extending across the rear face of the first outer shield member and positioned at a predetermined distance therefrom, whereby the web is configured to absorbs and diffuse impact energy when the system is applied to a corresponding joint.

BRIEF DESCRIPTION OF THE DRAWINGS

The foregoing aspects and the attendant advantages of the present invention will become more readily appreciated by reference to the following detailed description, when taken in conjunction with the accompanying drawings, wherein:

FIG. 19 is an exemplary diagram showing representative locations for protective suspension systems on a human body.

FIG. 20 is an exemplary diagram illustrating properties of various materials and use-specific manufactured assemblies for protective equipment systems.

FIG. 21 is an exemplary diagram showing the top, exploded view of a flexible substrate and external shield.

FIG. 22 is an exemplary diagram showing a cross section of an assembled flexible substrate attached to the rigid outer shell or shield of FIG. 21.

Figure 1A:
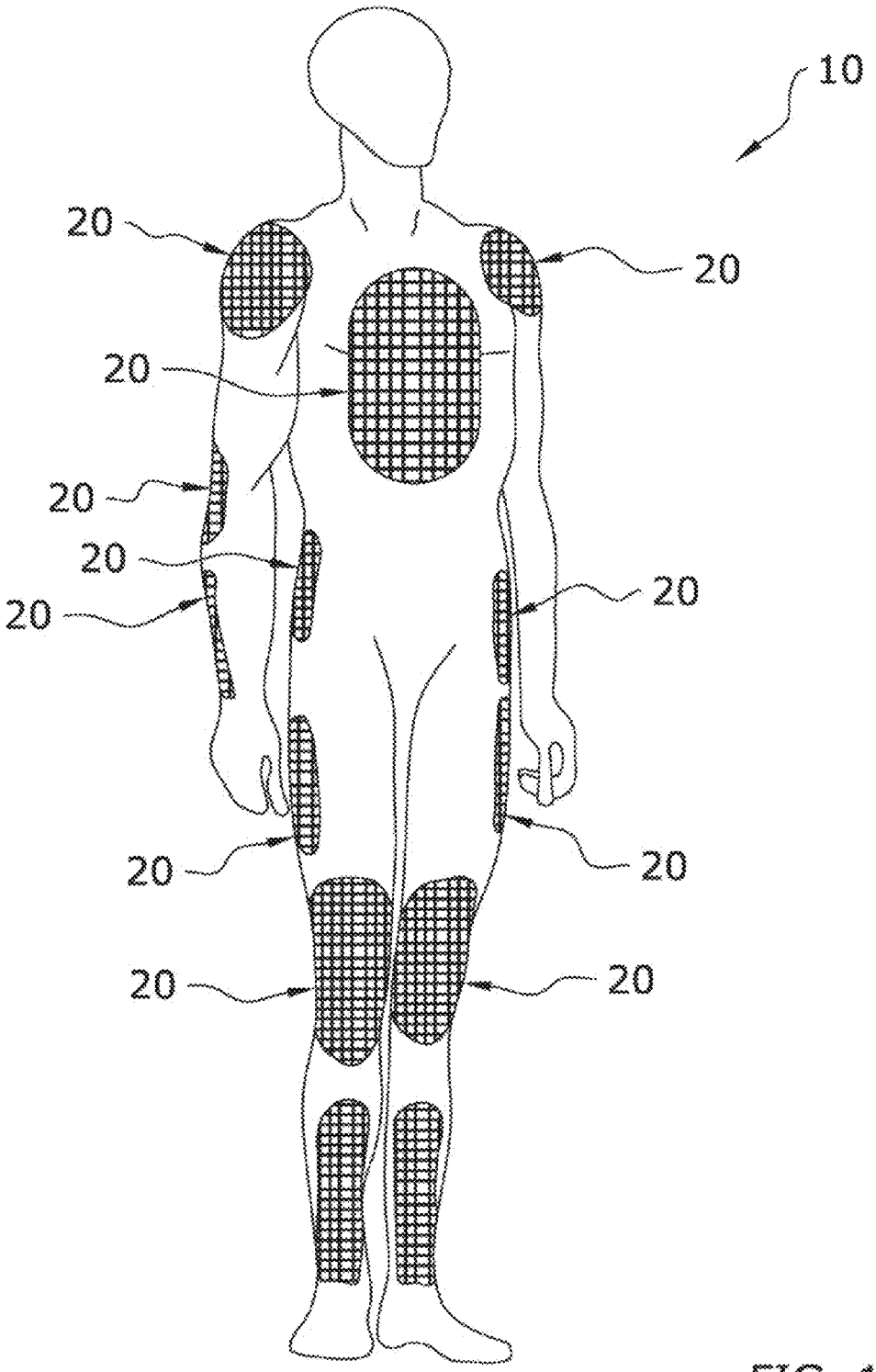
FIG. 1A is a front upper perspective view illustrating various representative locations that the gas compartments bladder system can protect.
Figure 1B:
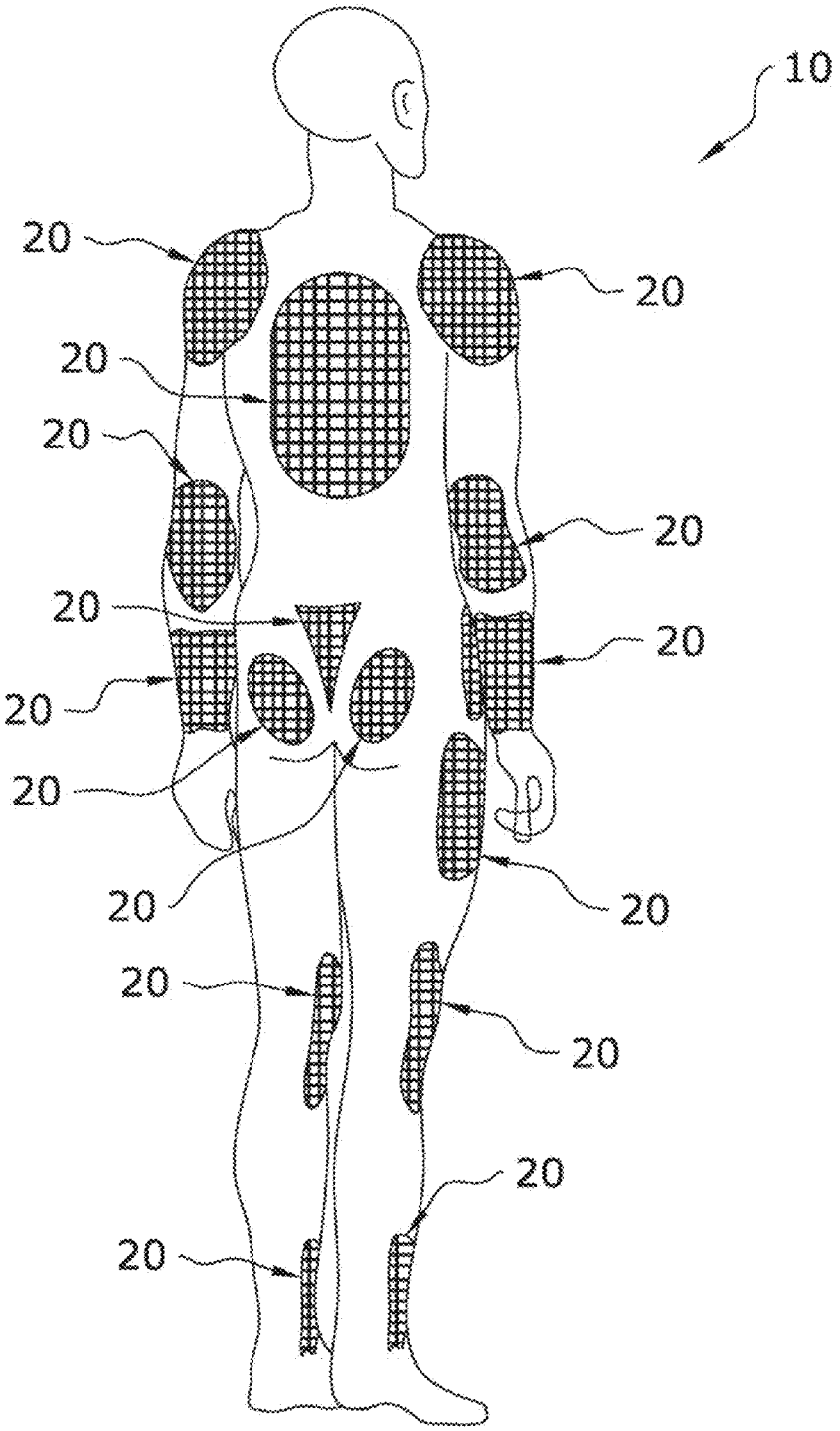
FIG. 1B is a rear upper perspective view illustrating various representative locations that the gas compartments bladder system can protect.
Figure 1C:
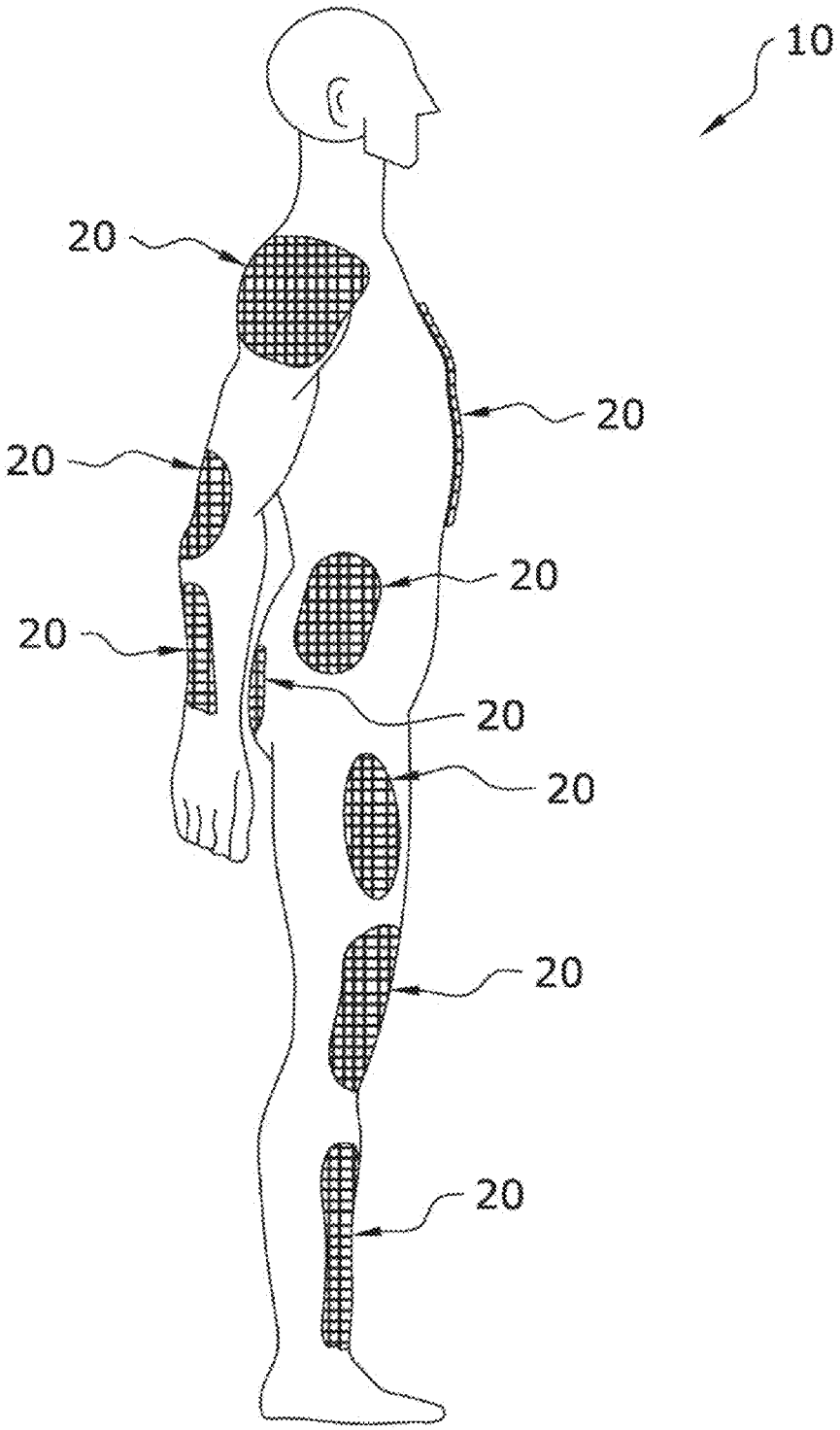
FIG. 1C is a side view illustrating various representative locations that the gas compartments bladder system can protect.
Figure 2A:
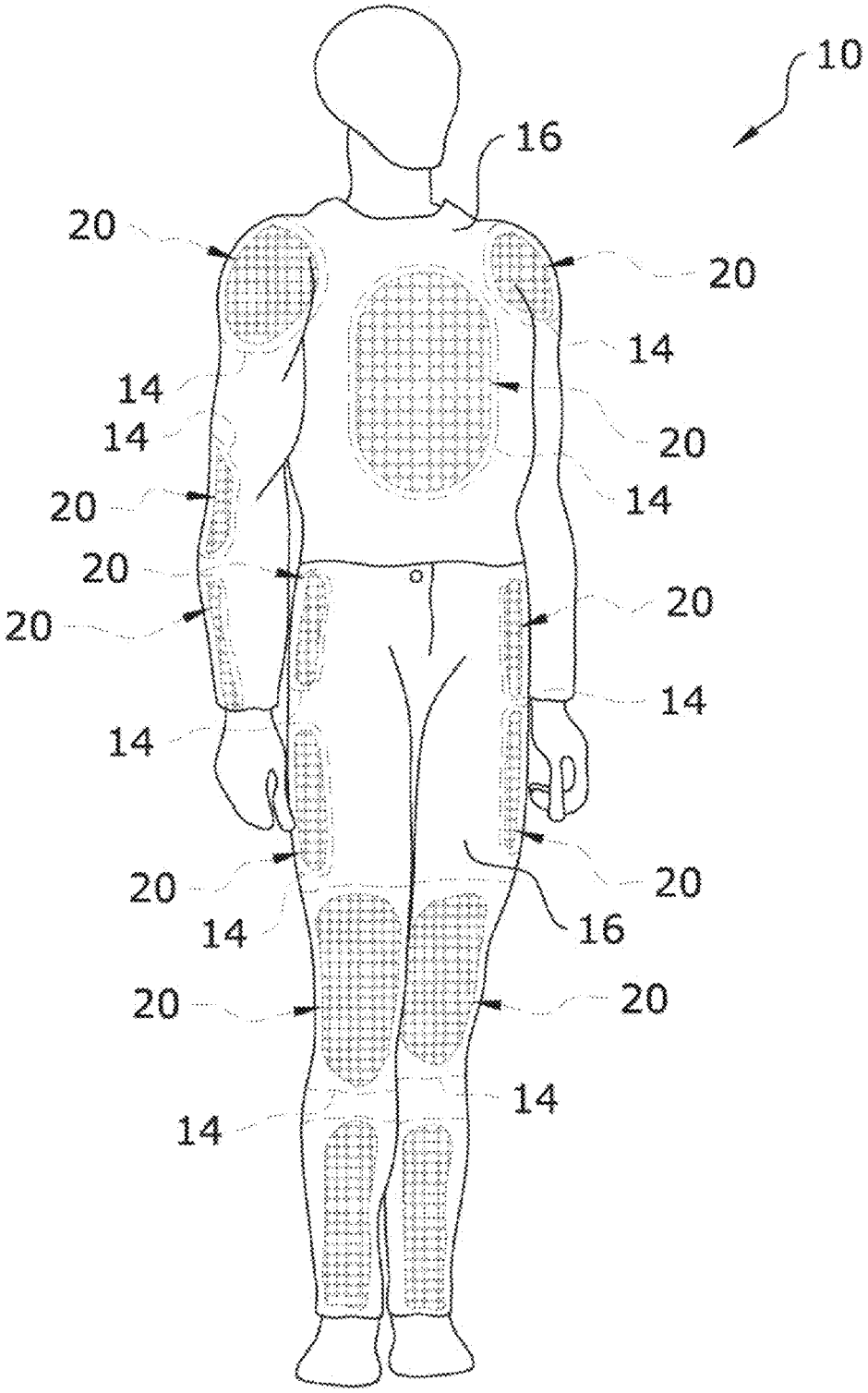
FIG. 2A is a front upper perspective view illustrating various representative locations that the gas compartments bladder system can protect within clothing.
Figure 2B:
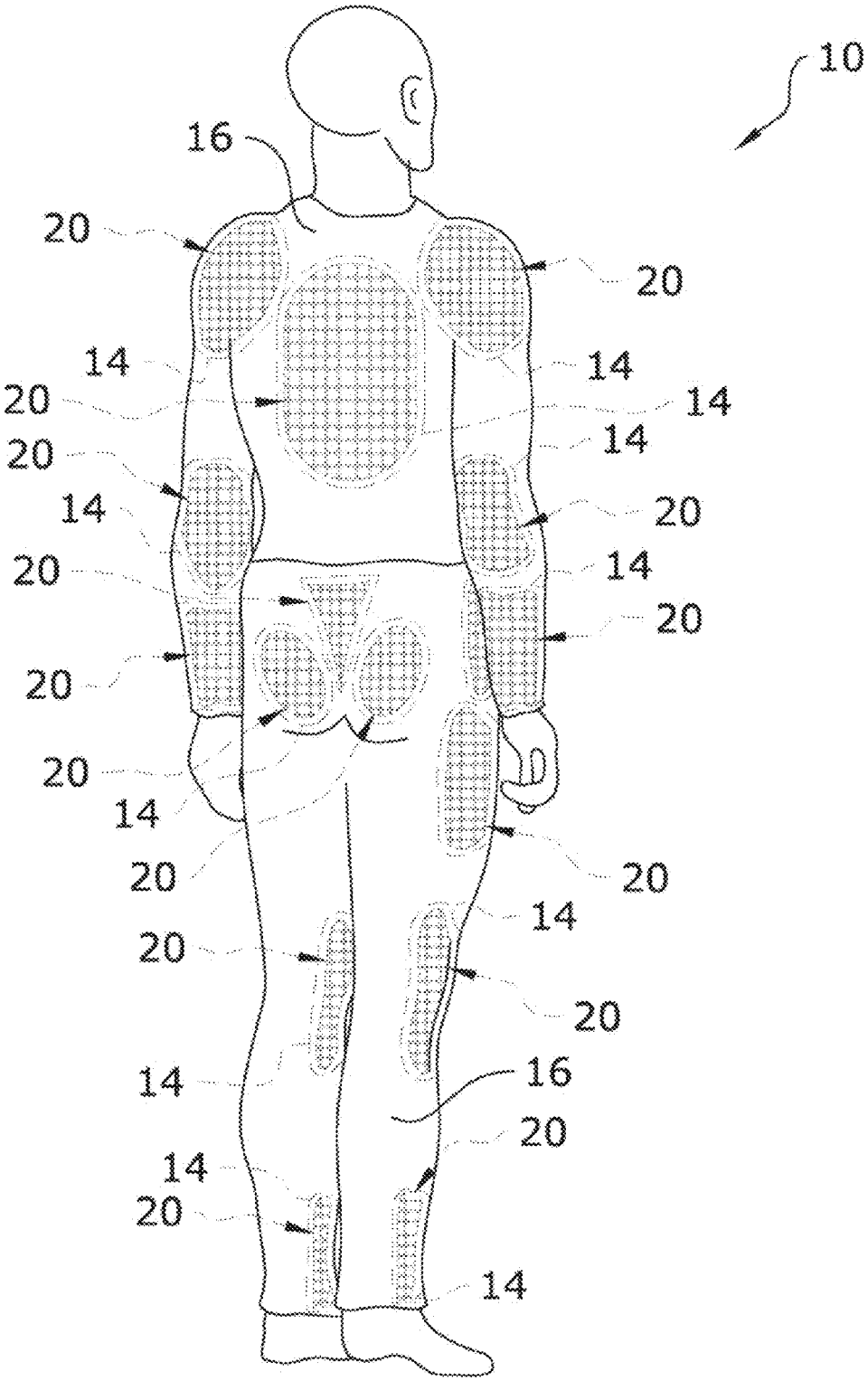
FIG. 2B is a rear upper perspective view illustrating various representative locations that the gas compartments bladder system can protect within clothing.
Figure 2C:
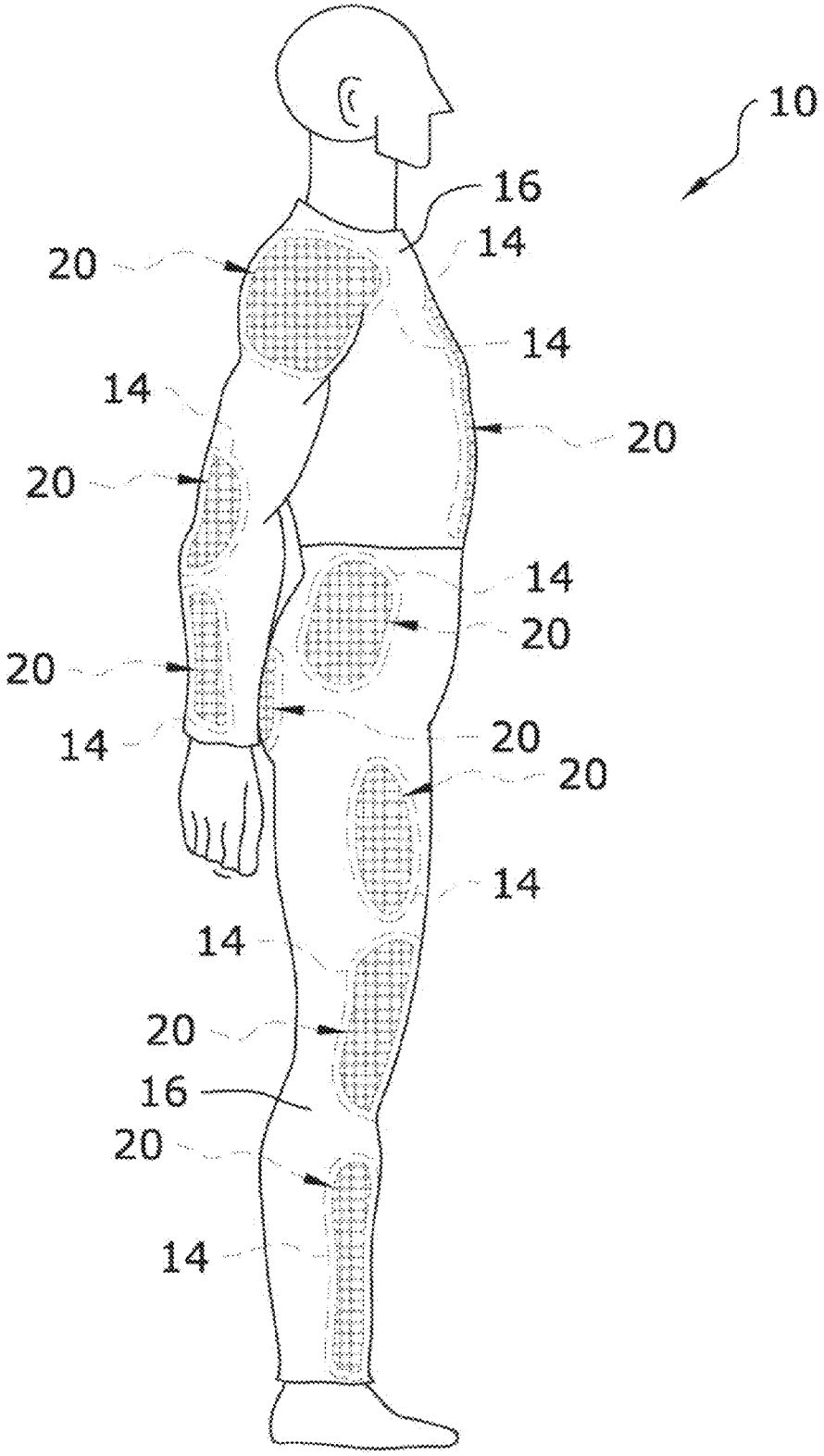
FIG. 2C is a side view illustrating various representative locations that the gas compartments bladder system can protect within clothing.
Figure 3A:
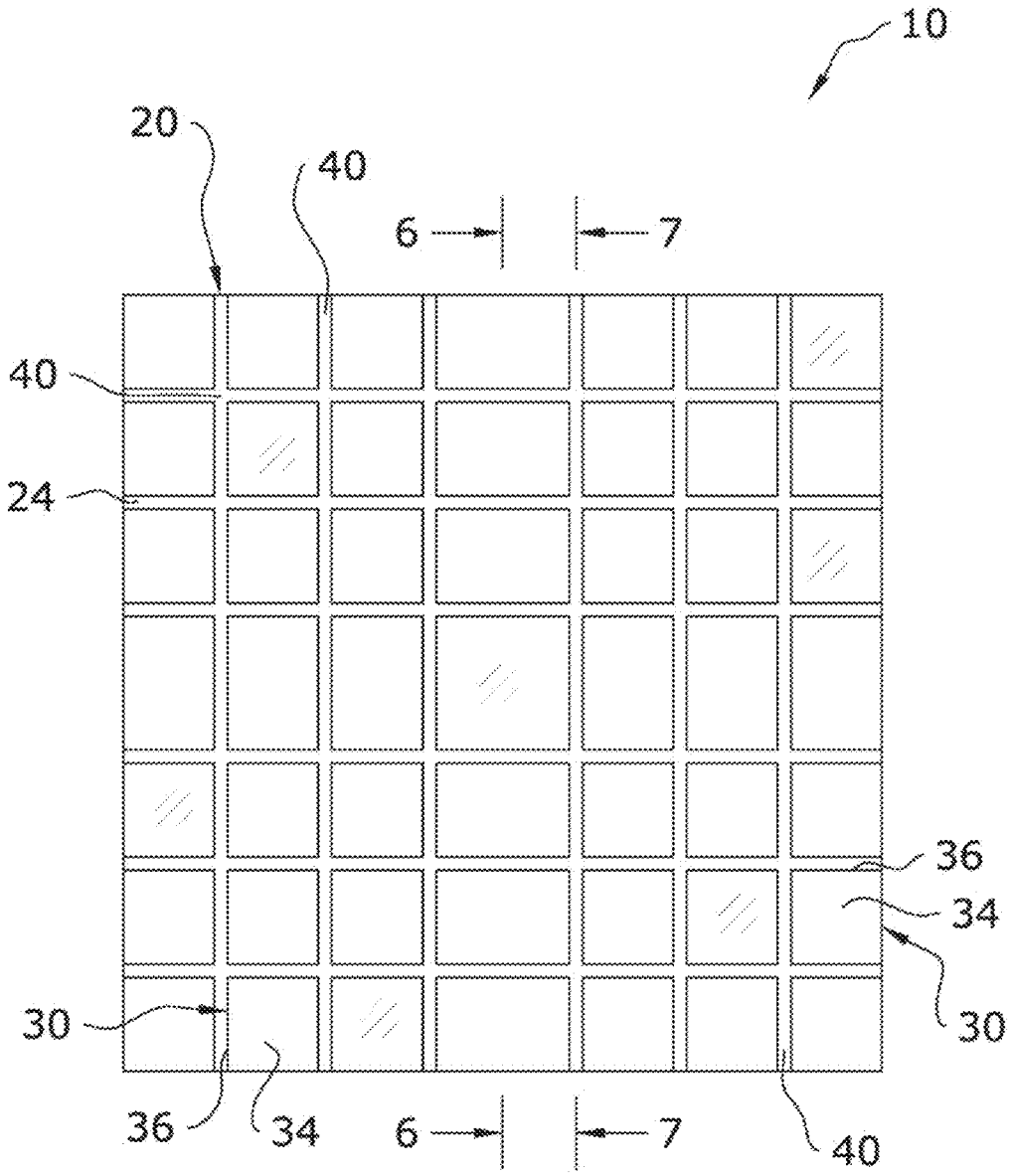
FIG. 3A is a top view of a gas compartments bladder showing a plurality of rectangular shaped compartments.
Figure 3B:
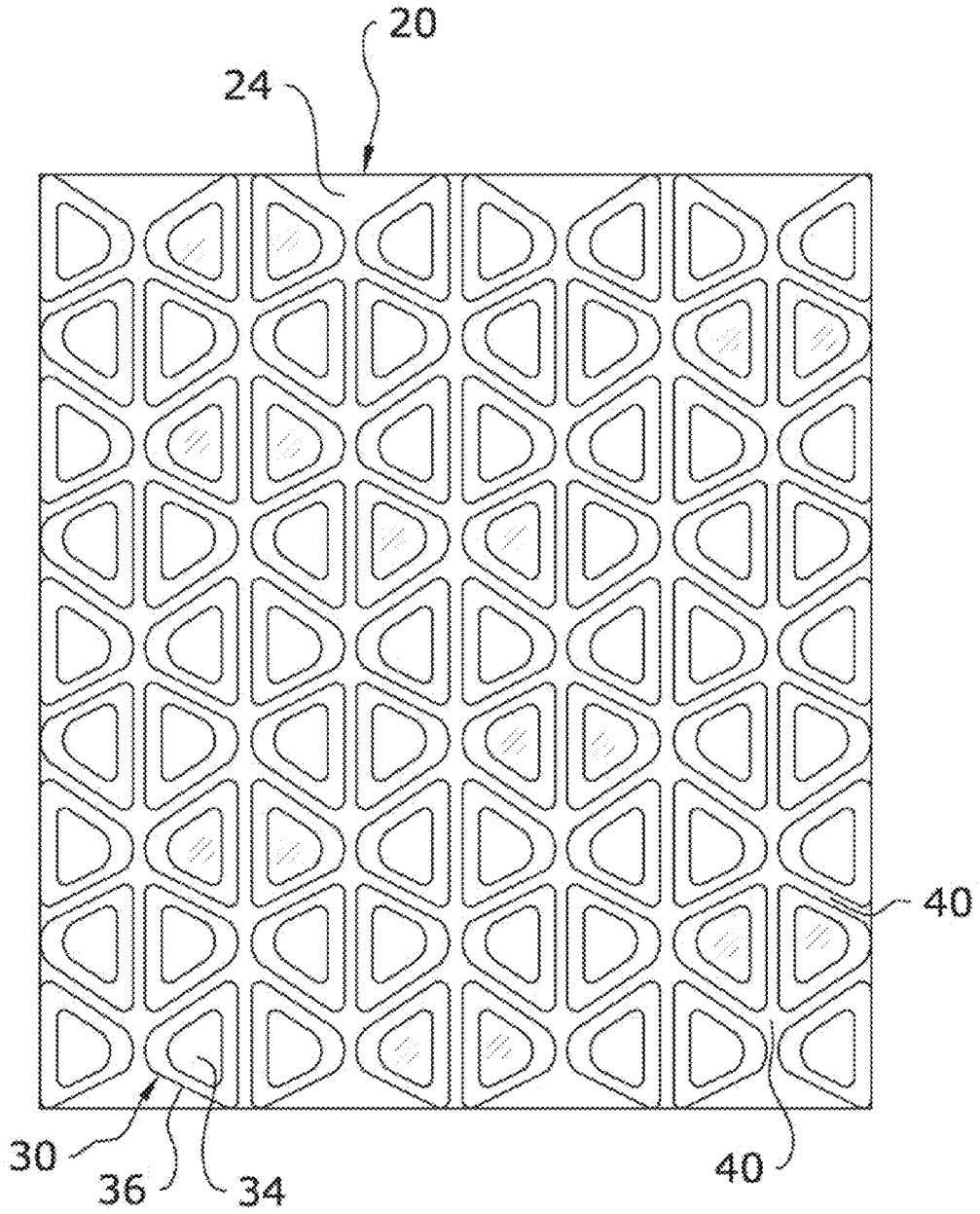
FIG. 3B is a top view of a gas compartments bladder showing a plurality of triangular shaped compartments.
Figure 3C:
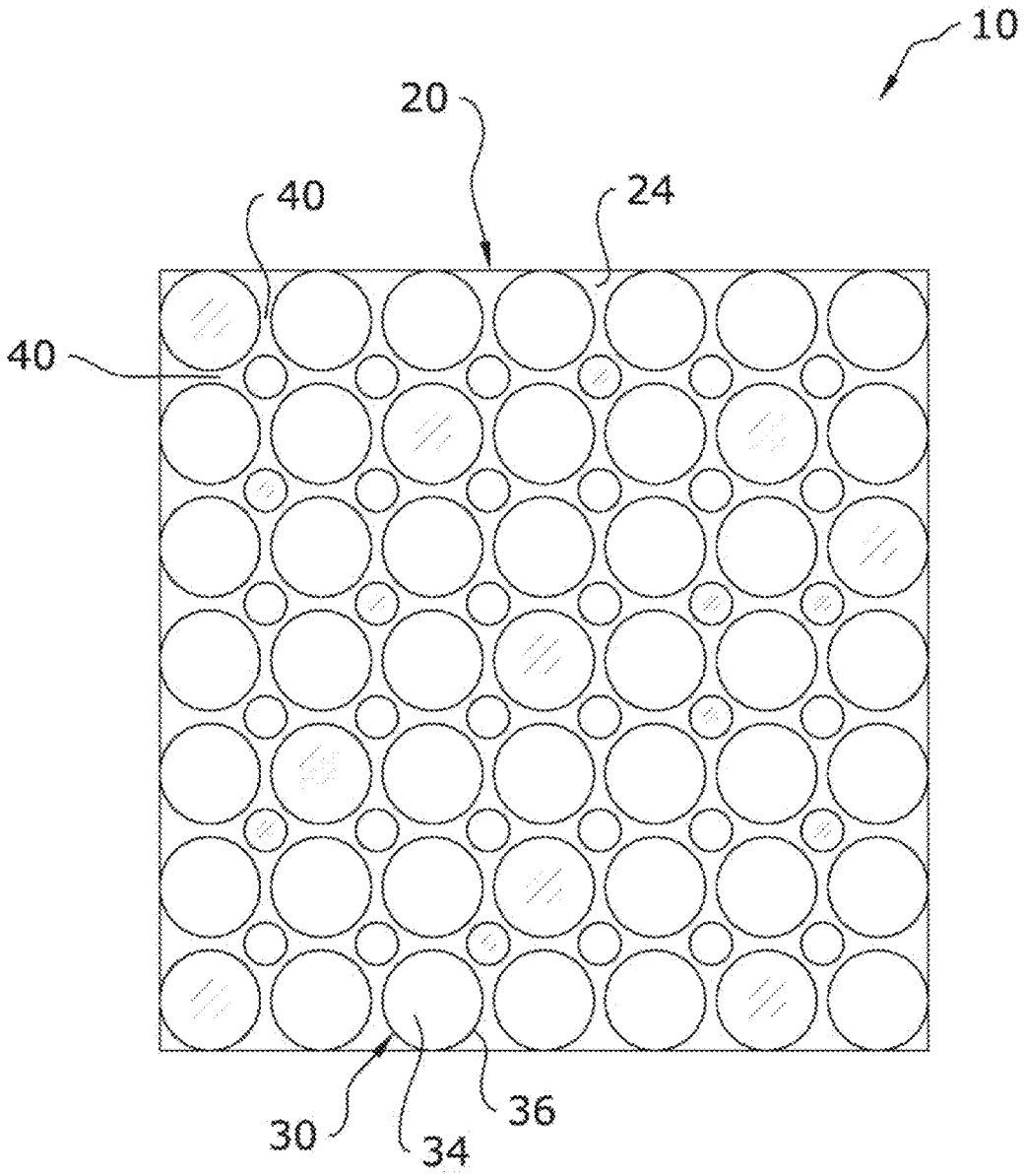
FIG. 3C is a top view of a gas compartments bladder showing a plurality of circular shaped compartments.
Figure 4:
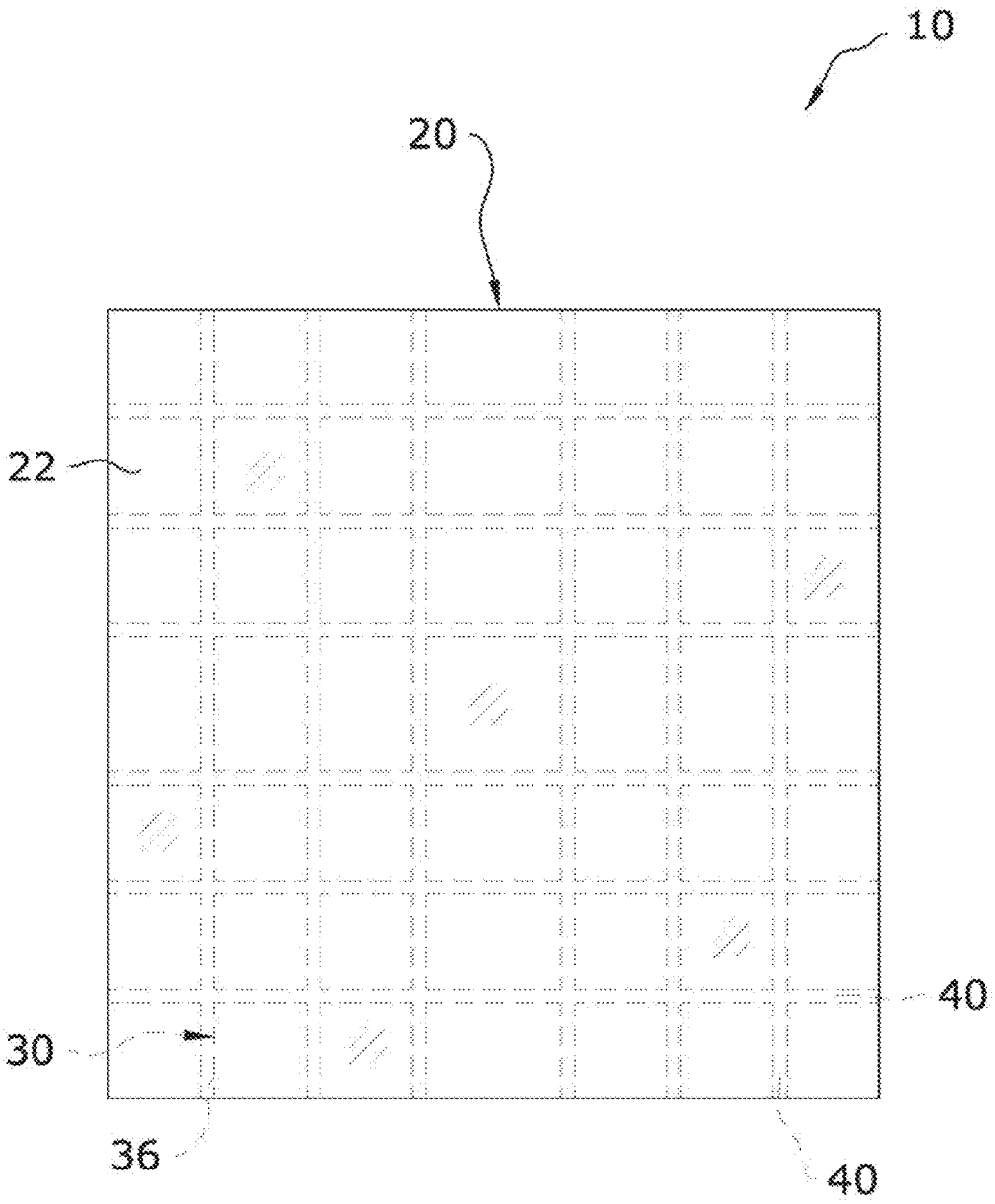
FIG. 4 is a bottom view of the FIG. 3A gas compartments bladder.
Figure 5:
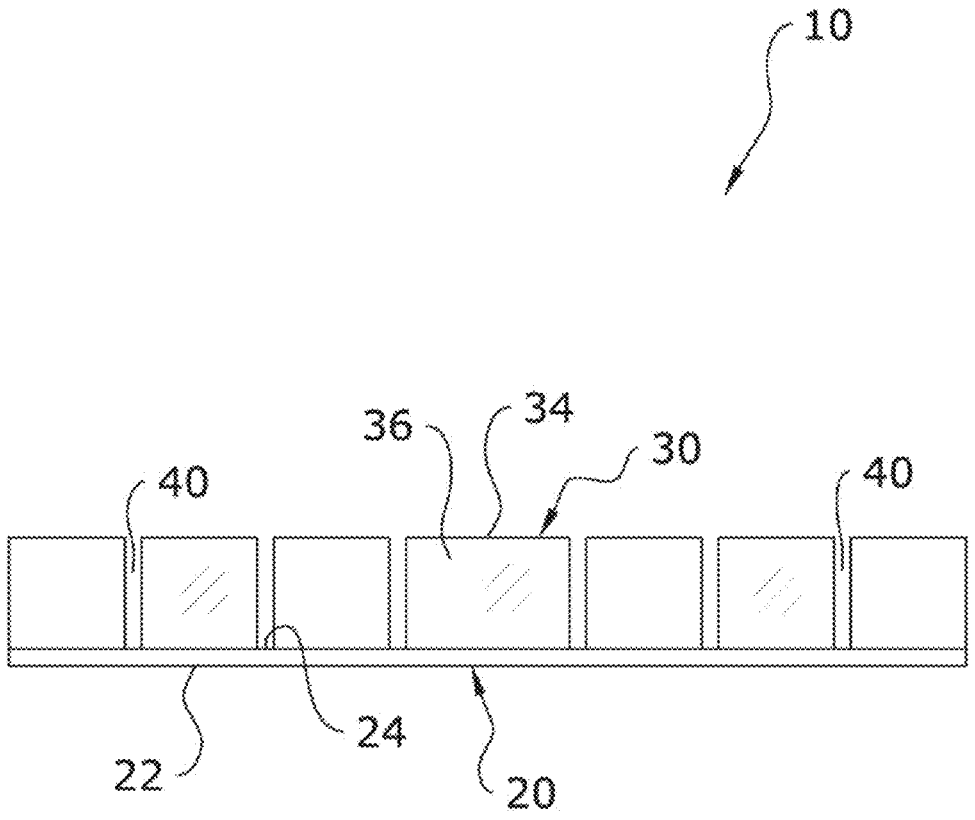
FIG. 5 is a side view of the gas compartments bladder with rectangular shaped compartments.
Figure 6A:
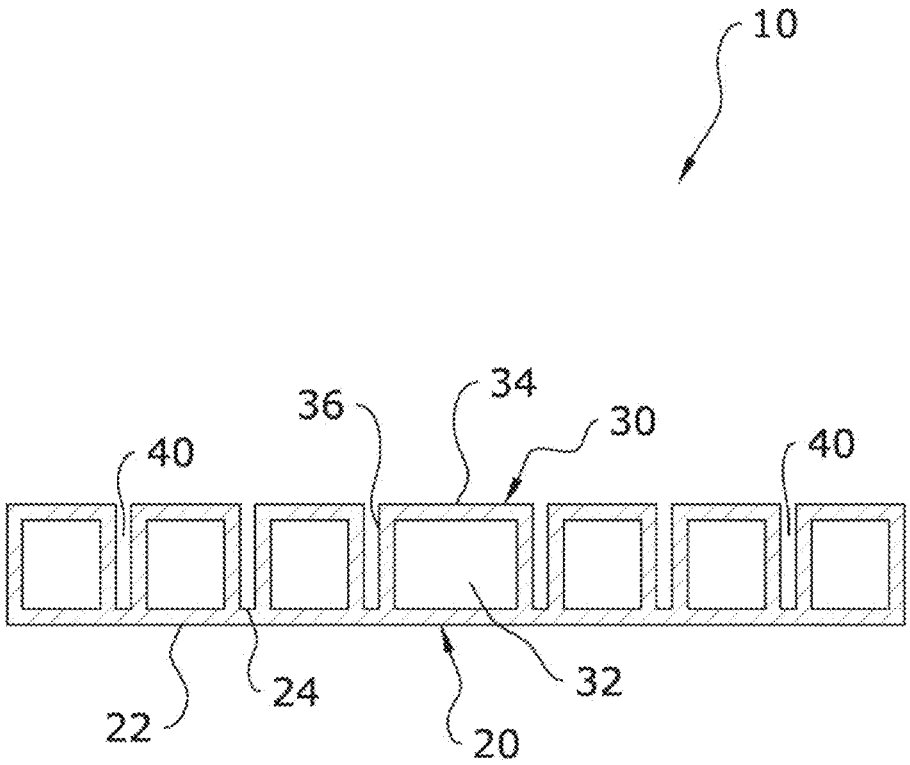
FIG. 6A is a cross sectional view taken along line 6-6 of FIG. 3A illustrating the interior cavity of the gas compartments.
Figure 6B:
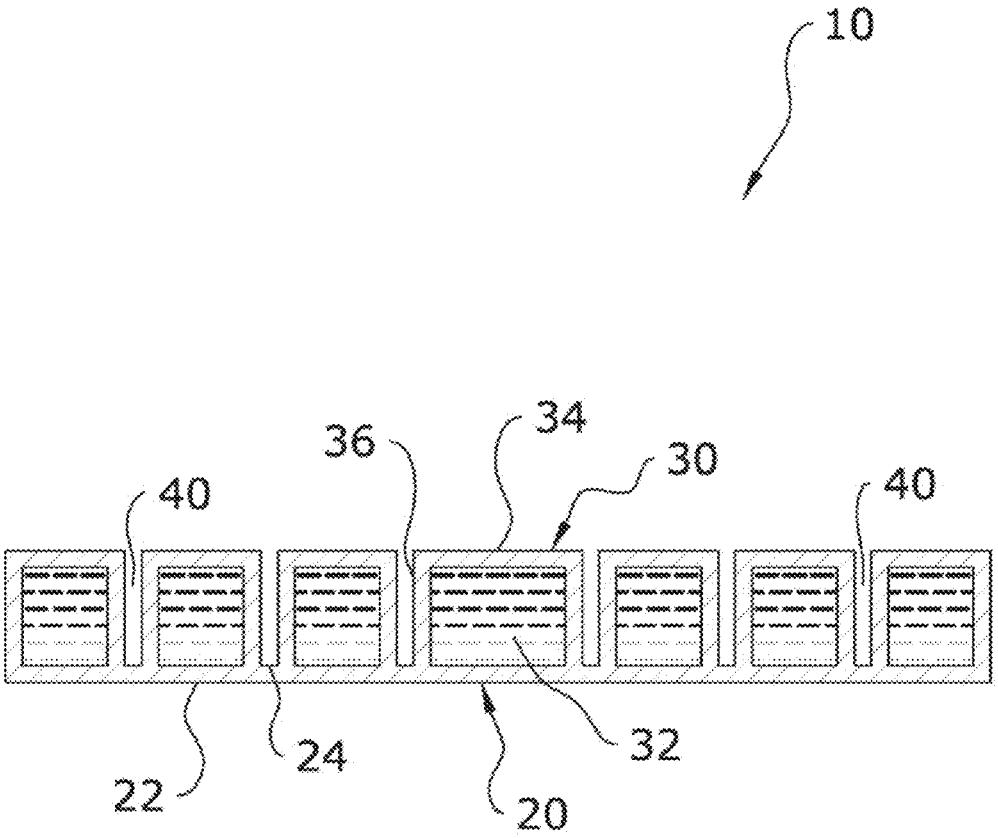
FIG. 6B is a cross sectional view taken along line 6-6 of FIG. 3A illustrating the interior cavity of the compartments filled with a liquid or gel.
Figure 7:
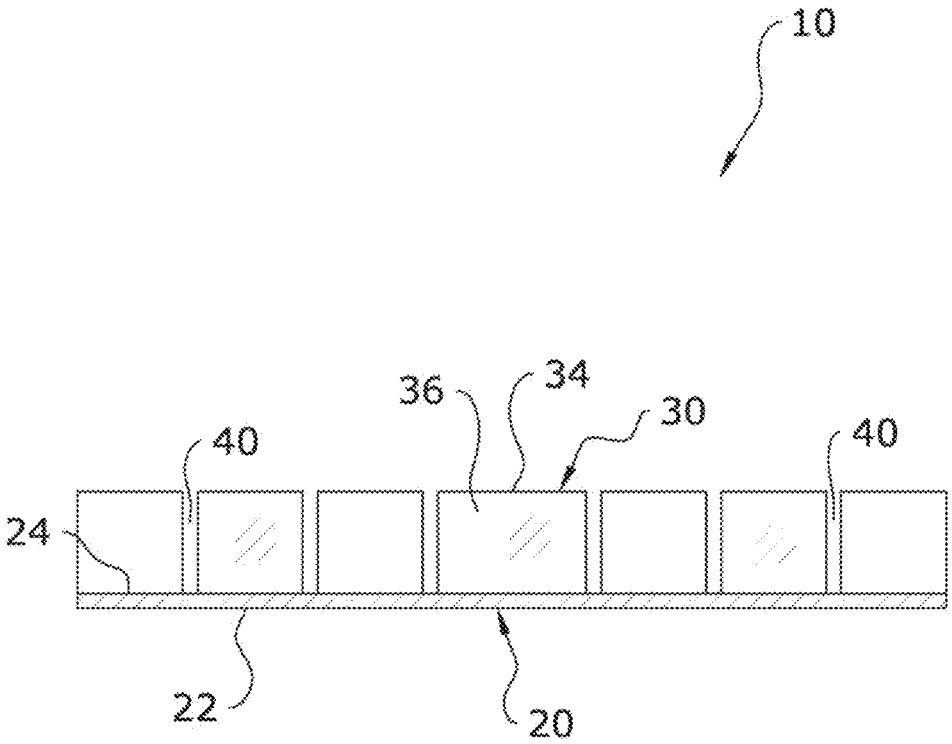
FIG. 7 is a cross sectional view taken along line 7-7 of FIG. 3A.
Figure 8A:
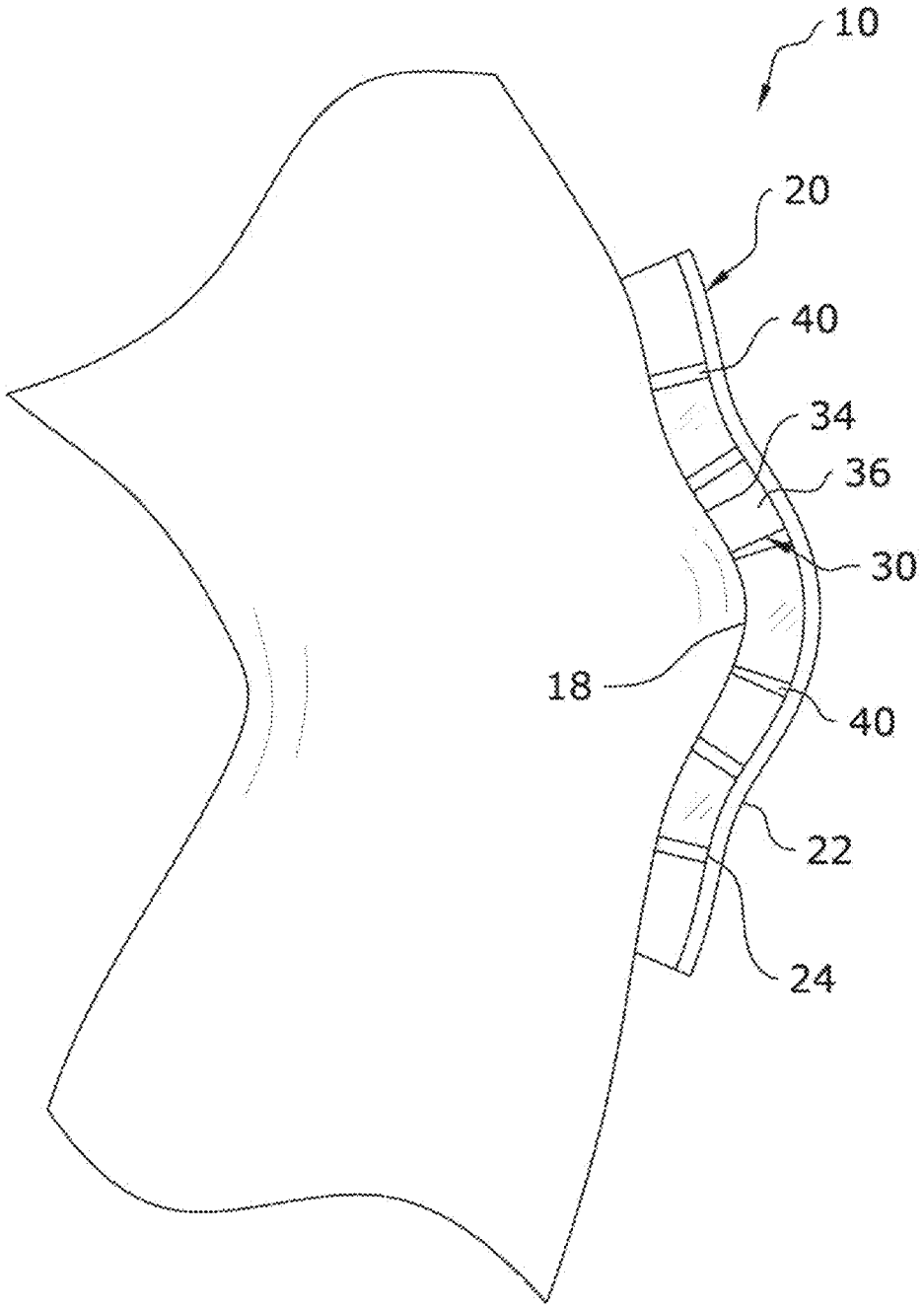
FIG. 8A is a cut away side view of the FIG. 3A gas compartments bladder positioned adjacent the knee of a user.
Figure 8B:
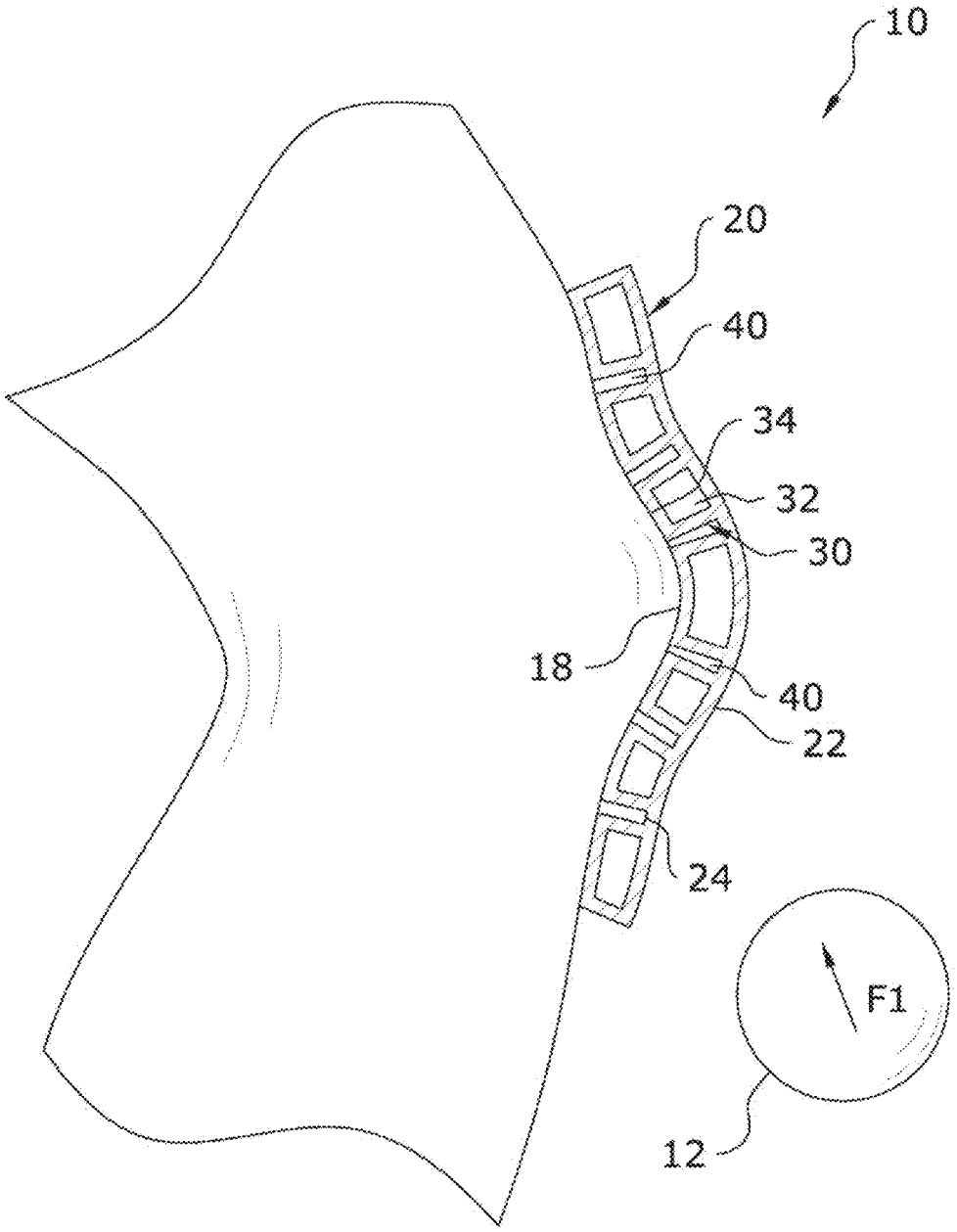
FIG. 8B is a cut away side view of the FIG. 3B gas compartments bladder positioned adjacent the knee of a user with an object approaching with a force F1.
Figure 8C:
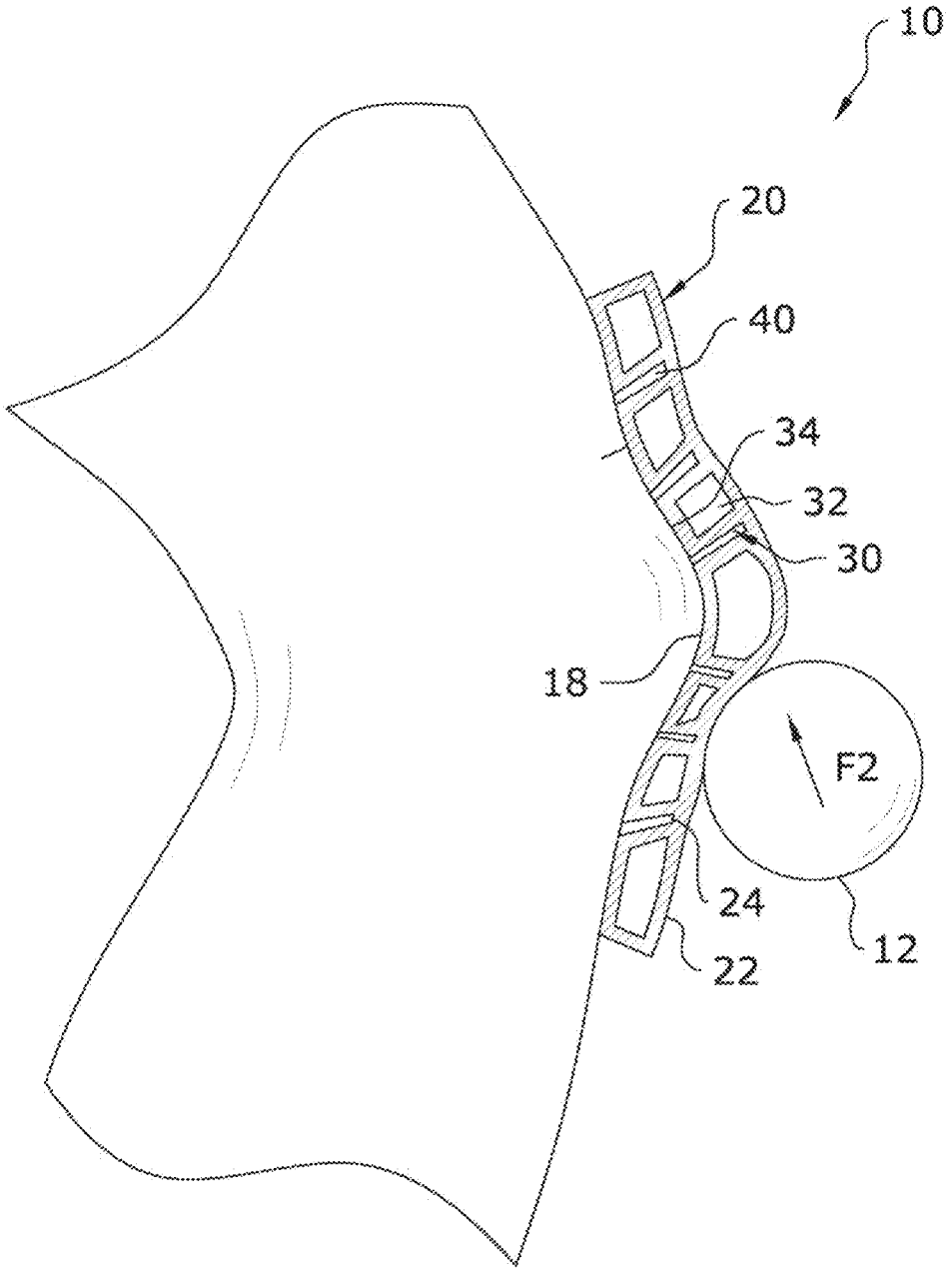
FIG. 8C is a cut away side view of the FIG. 3A gas compartments bladder positioned adjacent the knee of a user with the object impacting the gas compartments bladder with a force F2.
Figure 9:
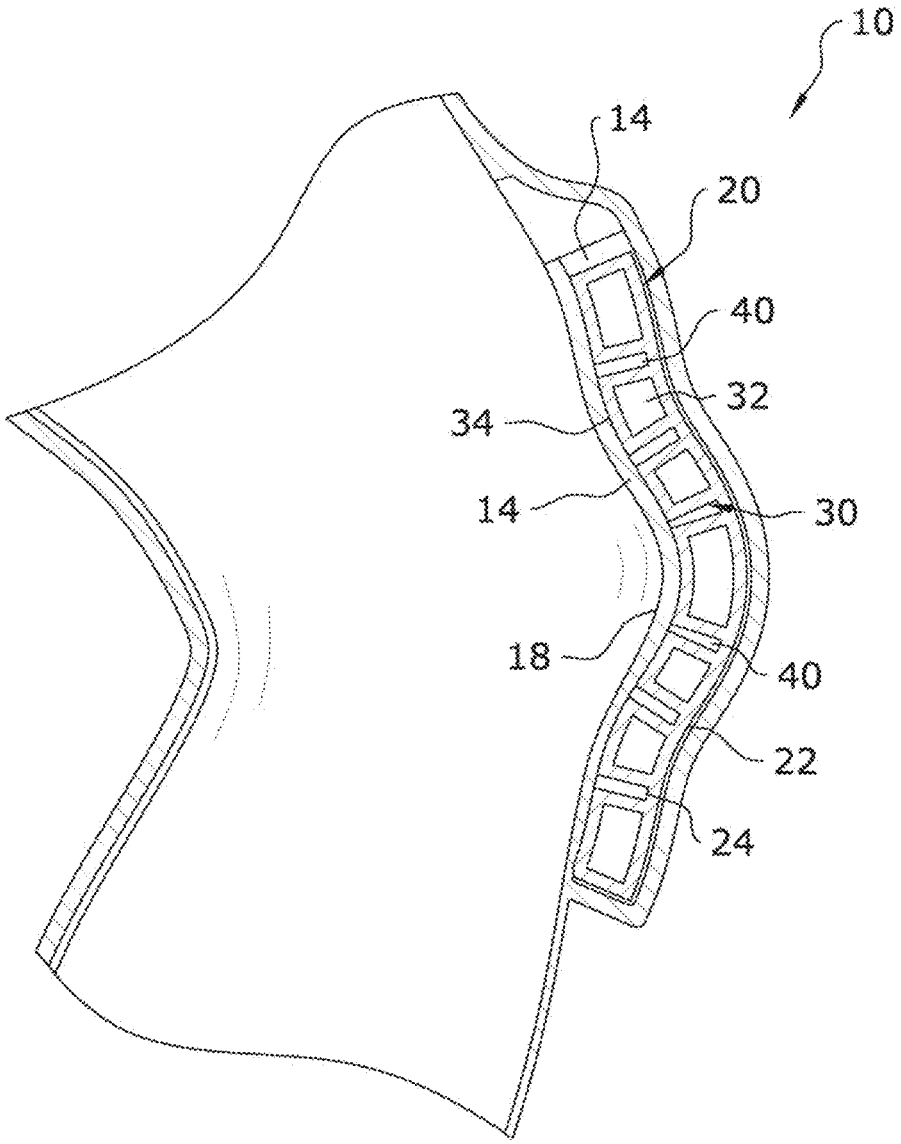
FIG. 9 is a side cutaway view of the FIG. 3A gas compartments bladder positioned adjacent the knee of the user and positioned within a receiver structure within clothing.

Reference symbols or names are used in the Figures to indicate certain components, aspects or features shown therein. Reference symbols common to more than one figure indicate like components, aspects or features shown therein.

DETAILED DESCRIPTION

Specific embodiments of the inventive protective garments and accessories are described and illustrated below. The presently described personal garments and accessories are related to the protective equipment and systems described in applications Ser. No. 13/722,001, 61/736,281, 61/630,969 and 61/736,281. Alternate embodiments may be devised without departing from the sprit or the scope of the present disclosure. Additionally, well-known elements of exemplary embodiments will not be described in detail or will be omitted so as not to obscure relevant details. Further, to facilitate an understanding of the description, a discussion of several terms used herein follows.

The work "exemplary" is used herein to mean "serving as an example, instance or illustration." Any embodiment described herein as "exemplary" is not necessarily to be construed as preferred or advantageous over other embodiments. Likewise, the term "embodiments" is not exhaustive and does not require that all embodiments include the discussed feature, advantage or mode of operation.

The personal protective garments and accessories are comprised of (i) an outer shell with a flexible substrate which provides a noticeable gap between the player and the outer shell of the system, as further described in pending U.S. provisional patent application 61/736,281; (ii) an outer shell and one or more bladders positioned between the outer shell and the user or player; and/or (iii) the outer shell and a bladder system inserted in the noticeable gap between the outer shell and the flexible substrate. The protective systems that include a web suspension structure but not a bladder are referred to as suspension systems, protective systems that include a bladder stabilization structure but not a web suspension structure are referred to herein as bladder systems and protective systems that include both web suspension structure and bladder systems are referred to herein as bladder-suspension hybrid protective systems, or simply as hybrid systems.

Bladder Protective Systems

As further described in applications 61/630,969 and Ser. No. 13/722,001, FIGS. 1-18 illustrate bladder type protective equipment systems 10 that include a plurality of compartments or bladders 20. The bladders 20 may be positioned at various locations on the user's body, and the bladders are filed with a gas, gel or liquid. The individual compartments of the bladders are formed with membranes 60, 62 and function as padding to absorb energy from impacts. The bladders are preferably covered by a shield or shell 80 to protect the exterior portion of the padding. These systems may be adapted to protect various locations or parts of the human body. The bladders, or gas compartments as referred to herein correspond to and are referred to as "containers" in U.S. Pat. No. 8,277,910, and the preferred gas compartments or bladders referred to herein are of the type described in the '910 patent. As used herein the terms bladder, compartment and container are used synonymously. The term bladder is also used to refer to an individual bladder, as well as to a group of individual bladders that are connected together to form a multi-bladder pad that overlies a specified body part or joint, such as a hip pad, an elbow pad. The multi-bladder pads with, or without an out shield are also referred to a protective equipment, a protective system, and these systems are formed into shapes and configurations adapted to provide protection for the particular body part to be protected.

The gas compartments or containers preferably are in fluid communication with each other, and provided with a fill valve that includes a reverse flow check valve. The gas compartments may be of various lengths, heights, widths and shapes, and are comprised of a first membrane and a second membrane, corresponding to membranes 60, 62 shown in FIG. 11*a* and described in application Ser. No. 13/722,001, incorporated by reference herein. The membrane material is capable of incurring significant impacts without rupturing. The most preferred material for the membranes is a 7-9-layer coextruded, low density polyethylene film with nylon strands incorporated within the membranes and which function to provide increased strength.

Figure 10A:
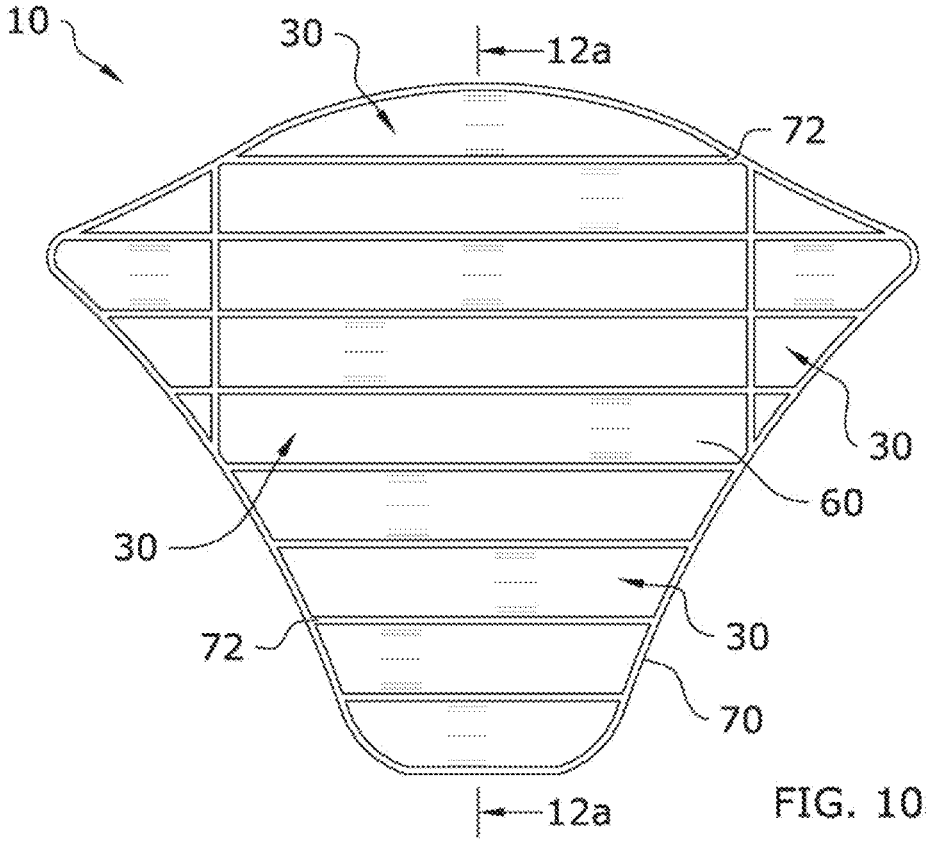
FIG. 10A is a top view of an alternative embodiment wherein the gas compartments bladder is formed into a shape for protecting the tailbone of a user and wherein the gas compartments bladder is formed from pairs of membranes.
Figure 11A:
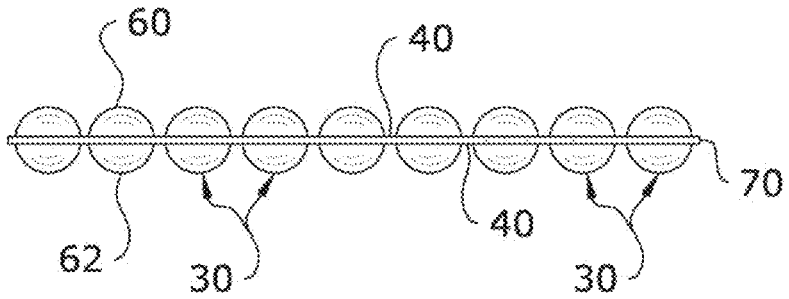
FIG. 11A is a side view of the FIG. 10A gas compartments bladder.
Figure 10B:
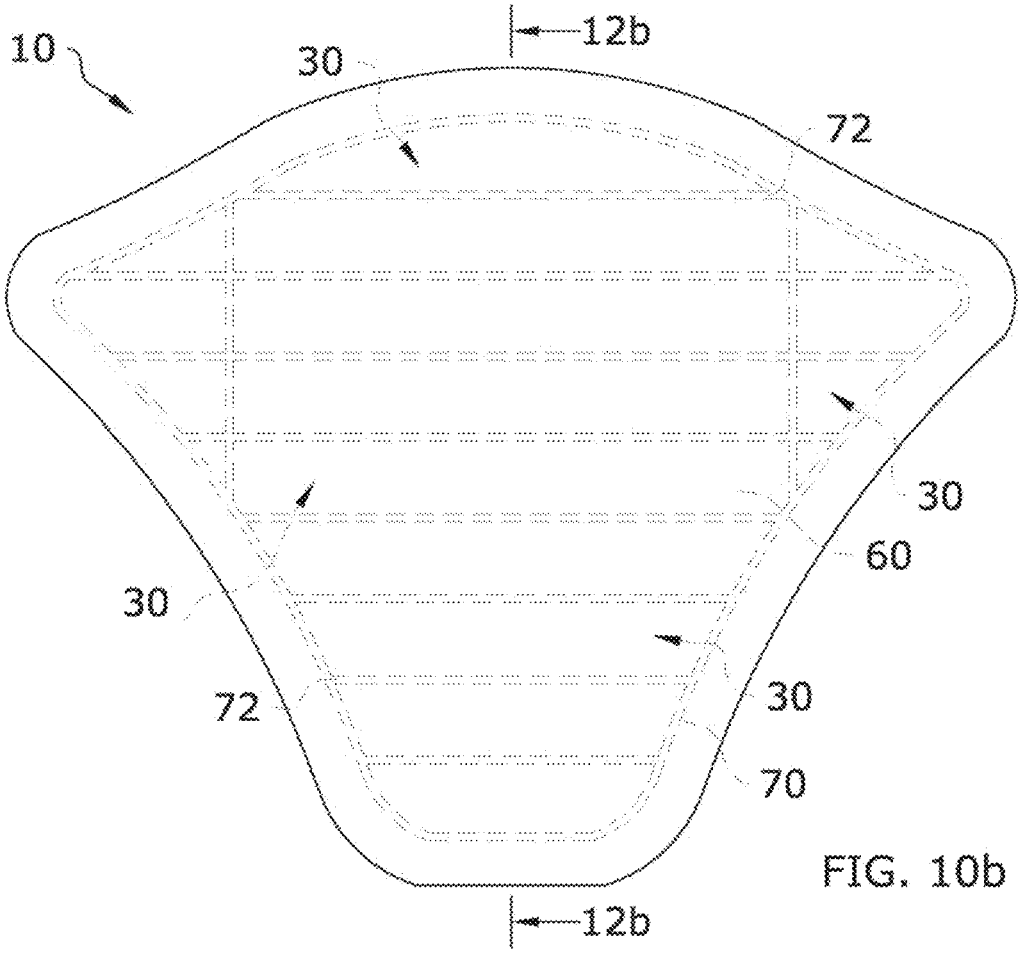
FIG. 10B is a top view of a shield positioned above the FIG. 10A gas compartments bladder.
Figure 11B:
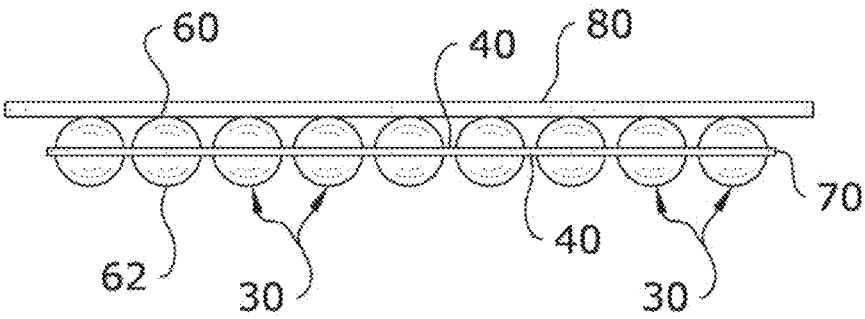
FIG. 11B is a side view of the FIG. 10B embodiment.
Figure 12A:
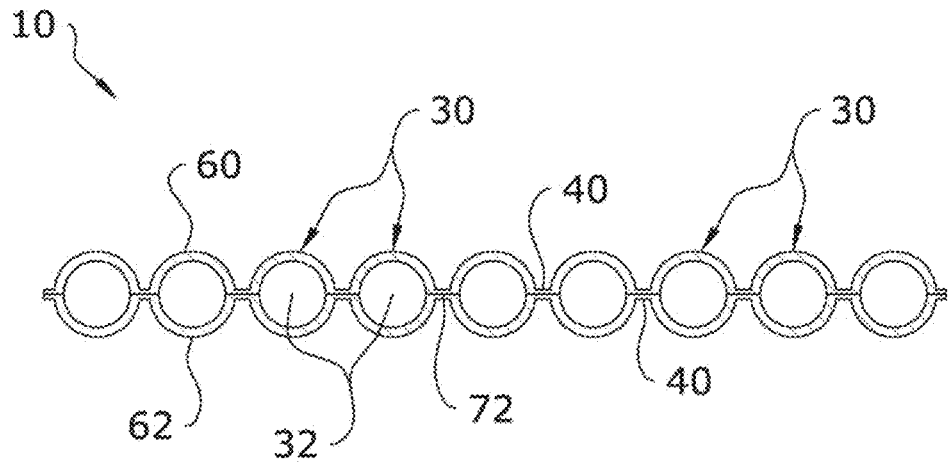
FIG. 12A is a cross sectional view taken along line 12A-12A of FIG. 10A.
Figure 12B:
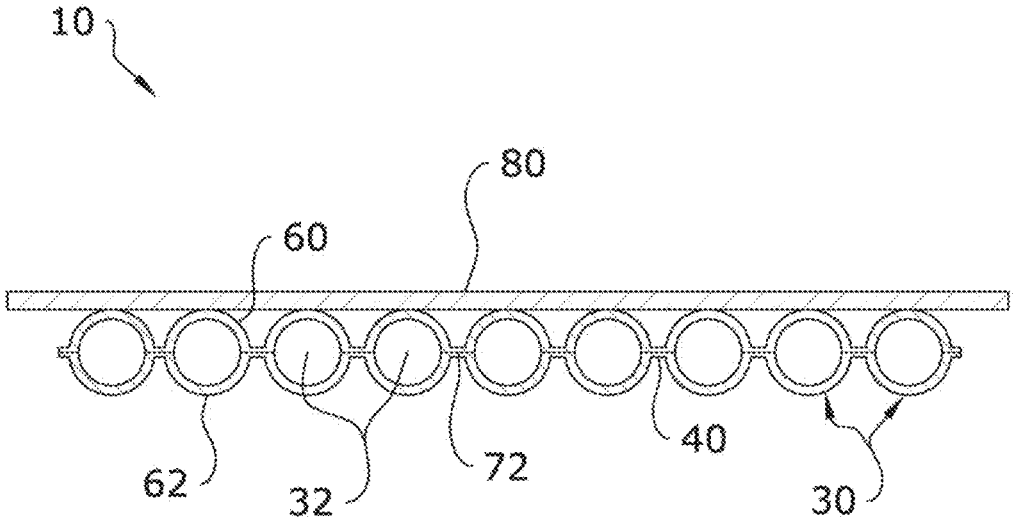
FIG. 12B is a cross sectional view taken along line 12*b*-12B of FIG. 10B.
Figure 13:
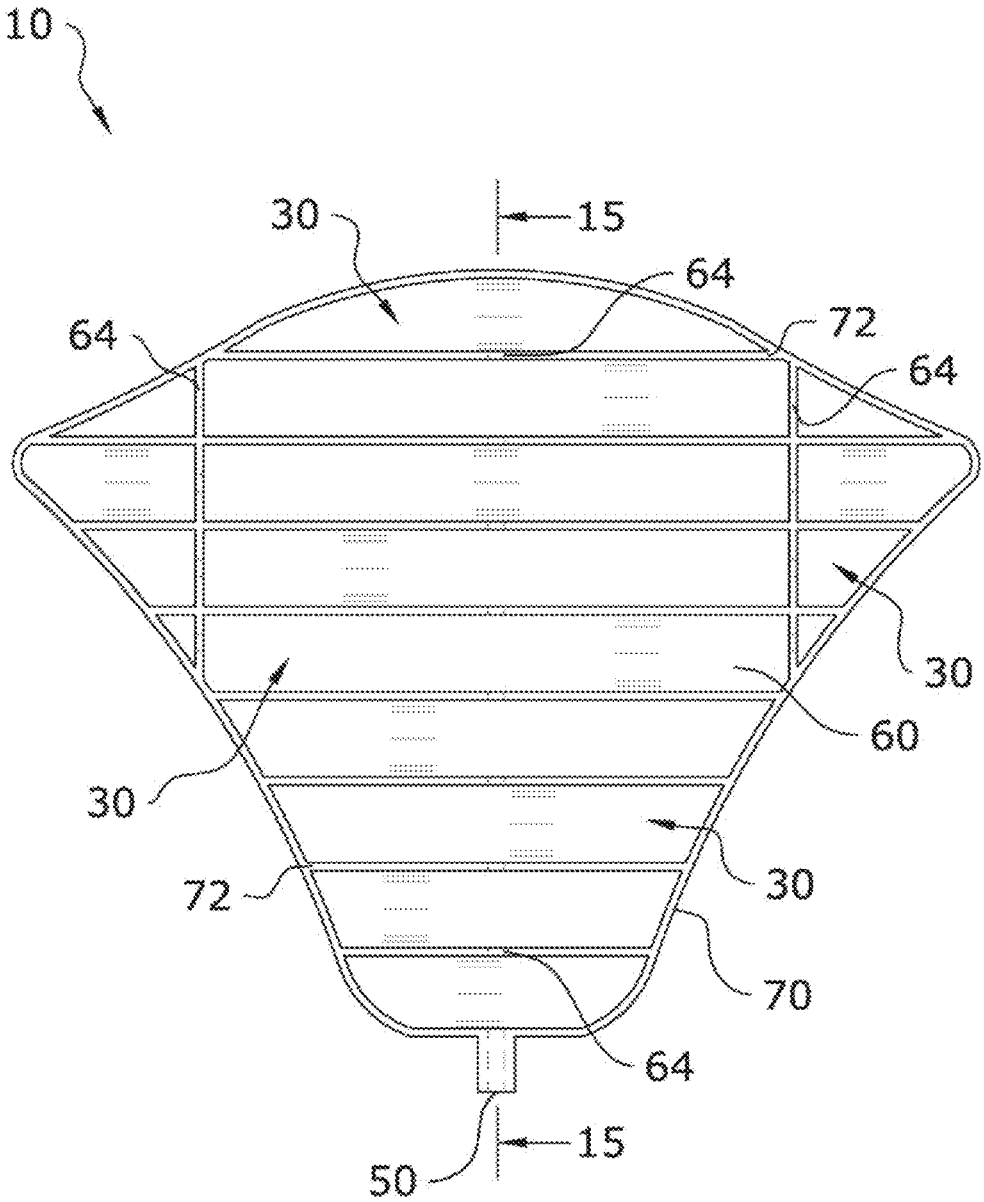
FIG. 13 is a top view of another alternative embodiment with connecting passages between the gas compartments.
Figure 14:
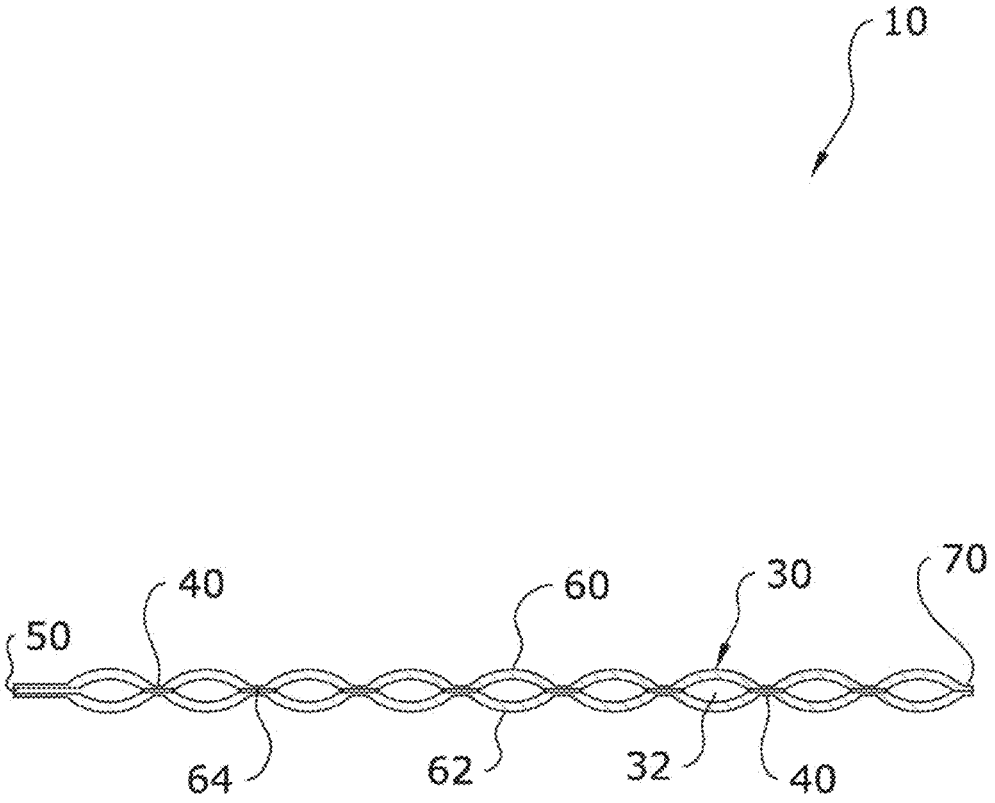
FIG. 14 is a side cutaway view along line 15-15 of the FIG. 13 with the protective padding in a deflated state.
Figure 15:
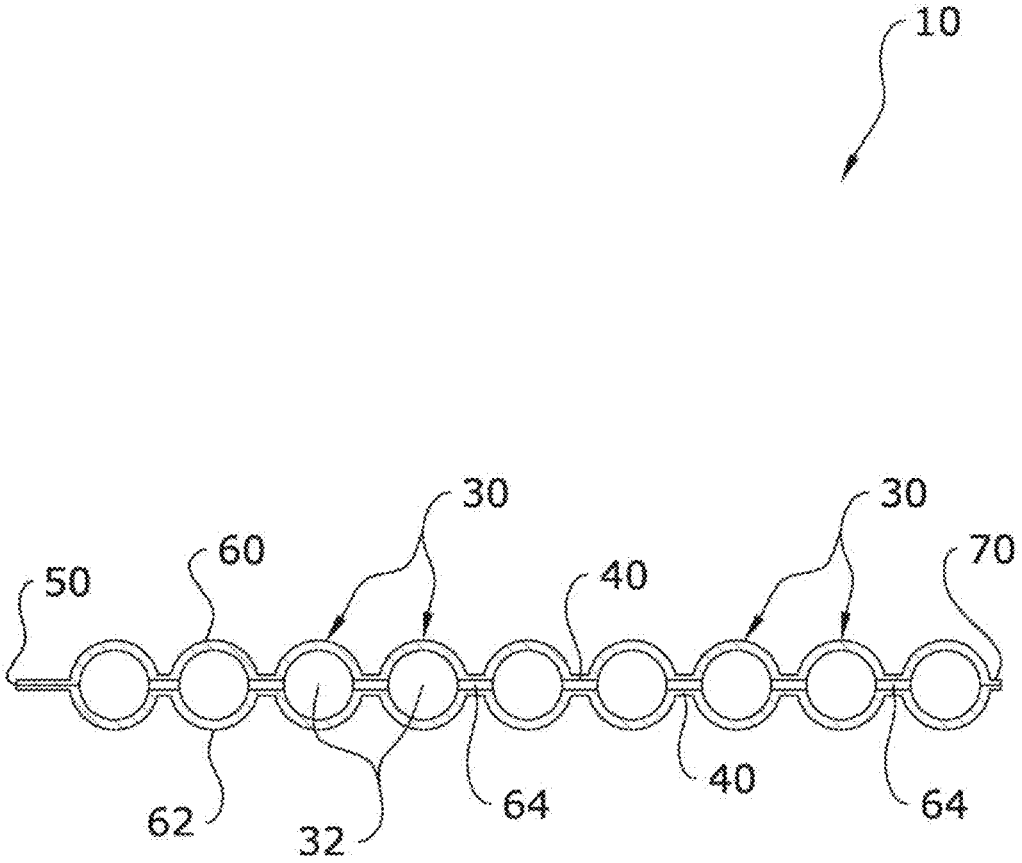
FIG. 15 is a side cutaway view along line 15-15 of the FIG. 13 embodiment in an inflated state.
Figure 16:
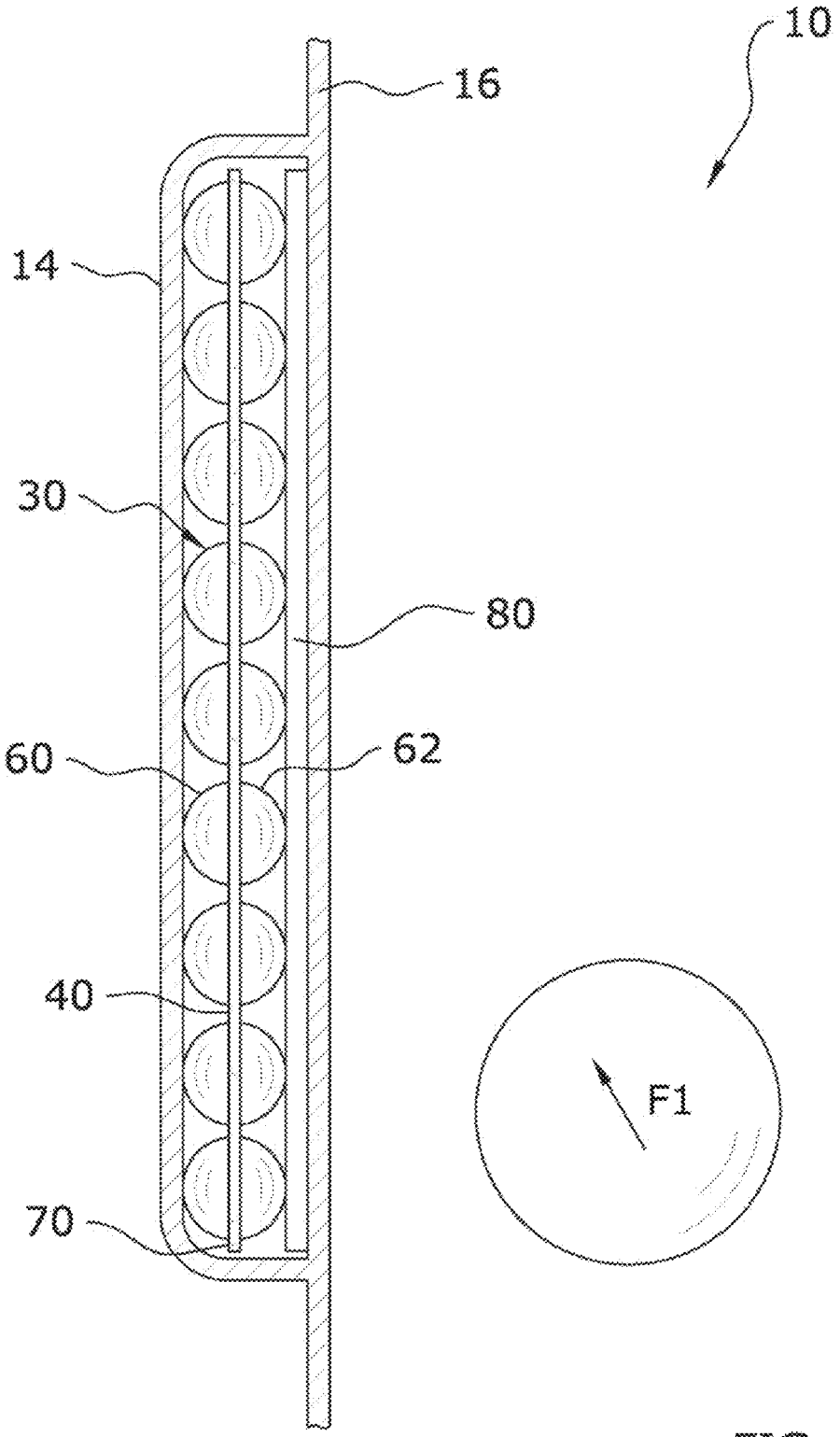
FIG. 16 is a side cutaway view of the gas compartments bladder system positioned within a receiver structure of clothing with a shield positioned on the outside portion of the gas compartments bladder and an object proceeding towards it.
Figure 17:
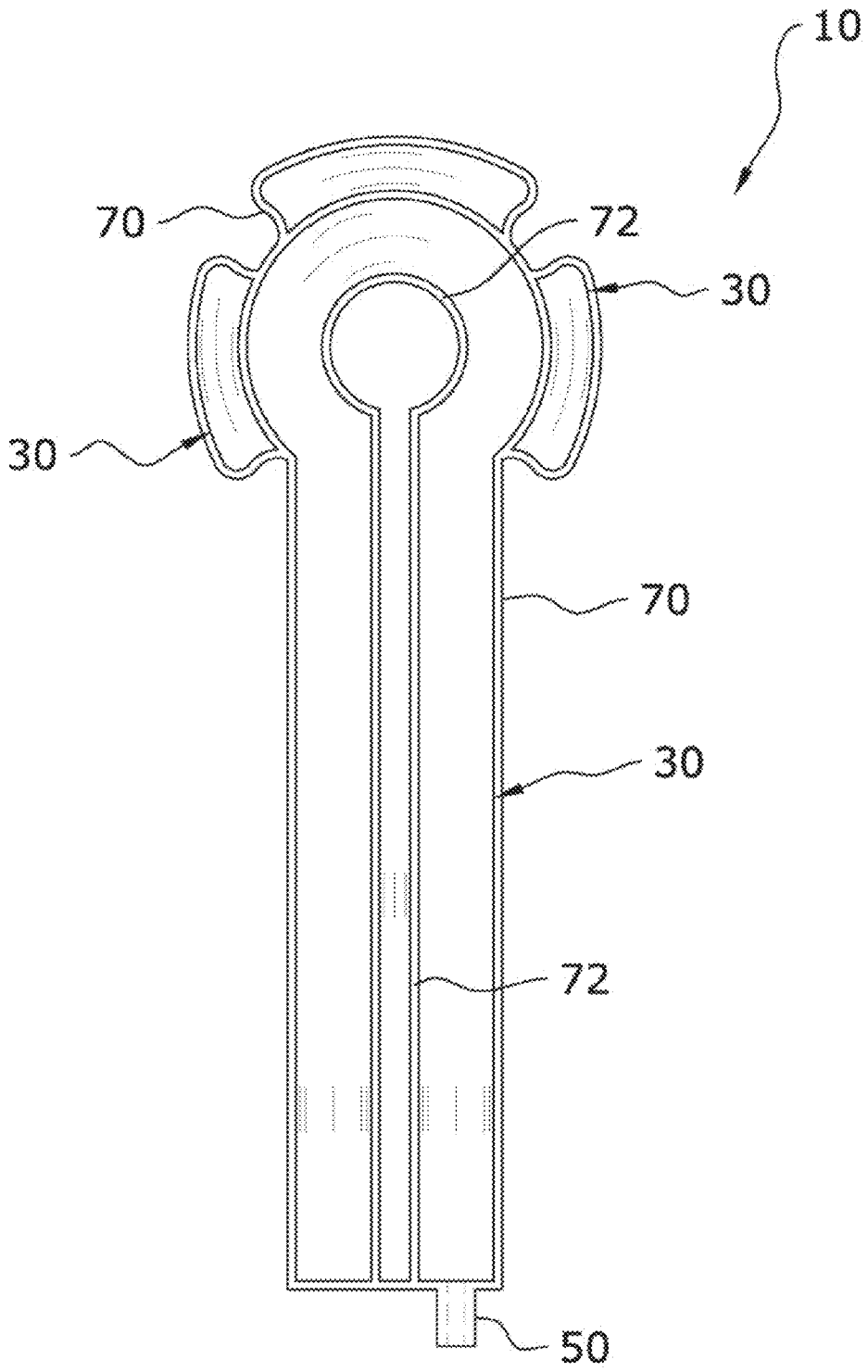
FIG. 17 is a top view of an alternative embodiment of the gas compartments bladder for use in a shin guard.
Figure 18:
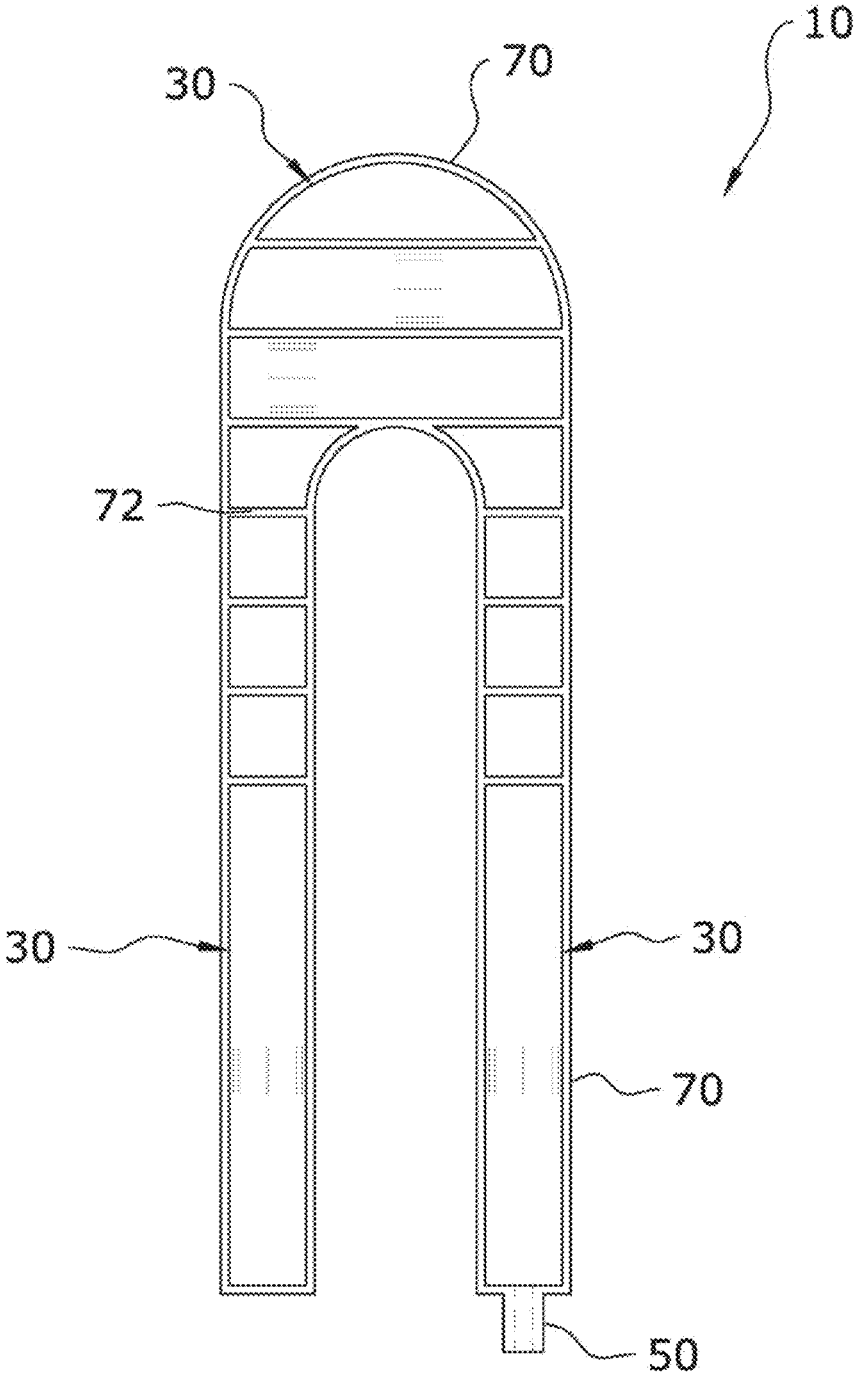
FIG. 18 is a top view of another alternative embodiment of the gas compartments bladder for usage in a shin guard.

FIGS. 3 through 18 illustrate the various configurations of the base structure of the gas compartments 30 which comprise the gas compartment bladder system. The compartments 30 are formed utilizing a first membrane 60 attached to a second membrane 62 at selected sealed portions 72 along with a sealed perimeter 70 as shown in FIGS. 10A, 10B and 11A. The first membrane 60 and the second membrane 62 are comprised of a plastic material capable of incurring significant impacts without rupturing. A shield (FIG. 11*b*) may be placed on the outside of the bladders. The bladders, with or without a shield may be placed inside of a receiver structure 14, such as a pocket, that may positioned on any of numerous locations 14 on the users uniform or clothing 16 as shown for example in FIG. 2A. Alternate embodiments of the bladder type protective system may be formed into various shapes for protecting various joints and bones on the human body by forming the system with a plurality of bladders or membranes into various shapes and sizes, and with individual compartments having any of various shapes and sizes as well. For example, FIGS. 17-18 illustrate the bladder type protective system having two different overall system configurations and several different individual compartment shapes, with each of the overall system configurations adapted for use as a knee and shin guard.

Suspension Protective Systems

Figure 23:
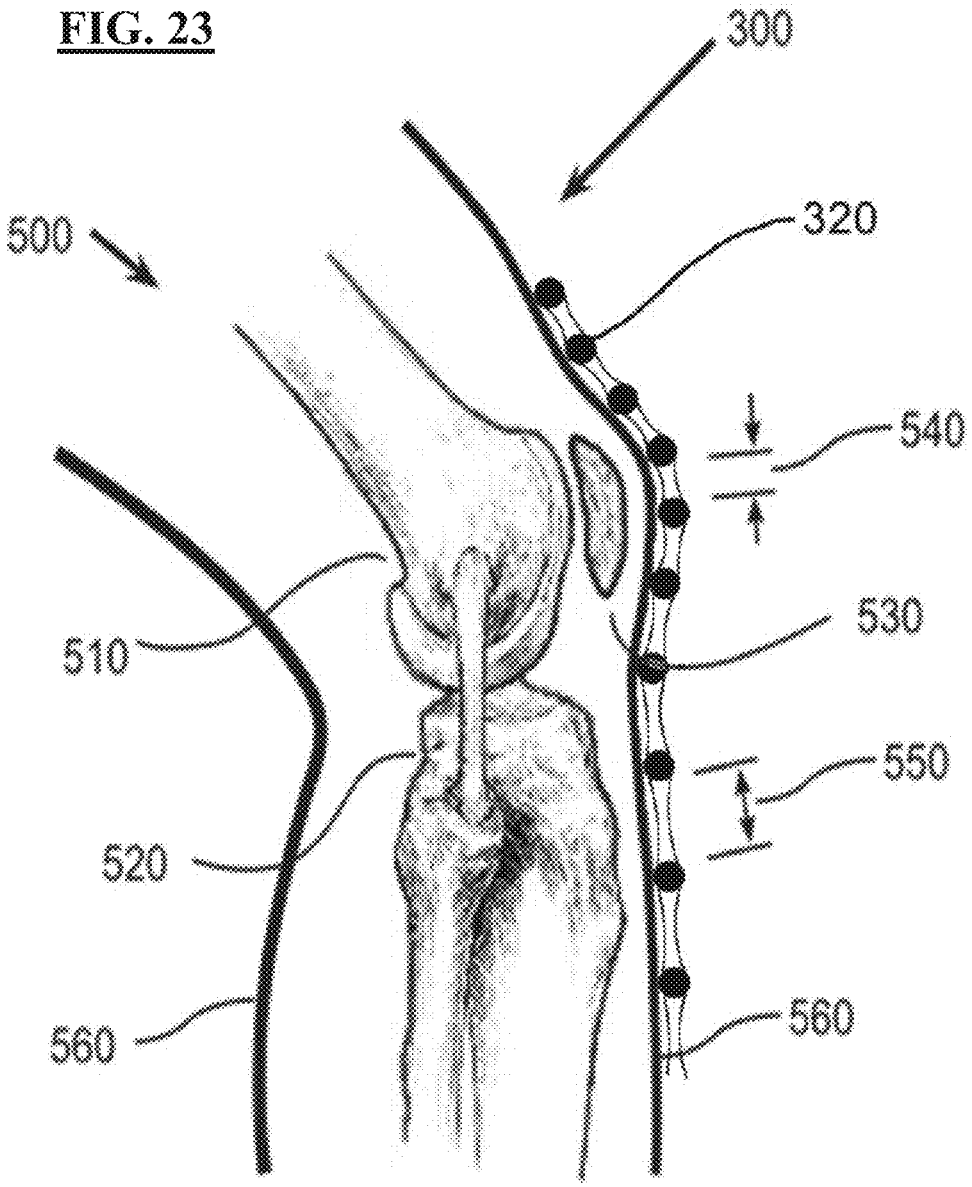
FIG. 23 is an exemplary diagram showing a cross section of human shin and knee with the application of a gas chamber bladder on the anterior surface of the shin.

An embodiment of the air gap or suspension type protective systems referred and described more fully herein, is shown for example in FIGS. 19-23. This embodiment corresponds to the air gap suspension type protective system as shown and described in application 61/736,281, which is also incorporated by reference herein. In the suspension type system 3 a flexible substrate functions to absorb and disperse energy that results from impacts. The flexible substrate may take the form of a web 310, with gaps 320, and is attached or bonded to an outer shell 4 at location 410. The space between the shell 4 and the web 310 may be air or other materials. An exemplary air suspension system for a knee is shown in FIG. 23.

Bladder Joint Protective Systems

With reference to FIGS. 24-28, bladder type protective systems particularly adapted for joints correspond to the joint protection systems described and shown in application 61/802,604, incorporated by reference herein. The FIGS. 24-28 systems are adapted to fully encompass the exterior of the joint being protected, and to move freely with the user's joint and adjacent bones and muscles of the user. The overall joint protection bladder system is comprised of a series of bladders that are shaped and sized to fit or be applied over a joint, such as an elbow or knee. Flex points or seams are positioned at various locations in the bladder system and permit the system to wrap around or partially wrap around the joint and adjacent body parts. Various geometric shapes and structures may be used to accomplish the wrapping capability of the joint protection system.

Figure 24:
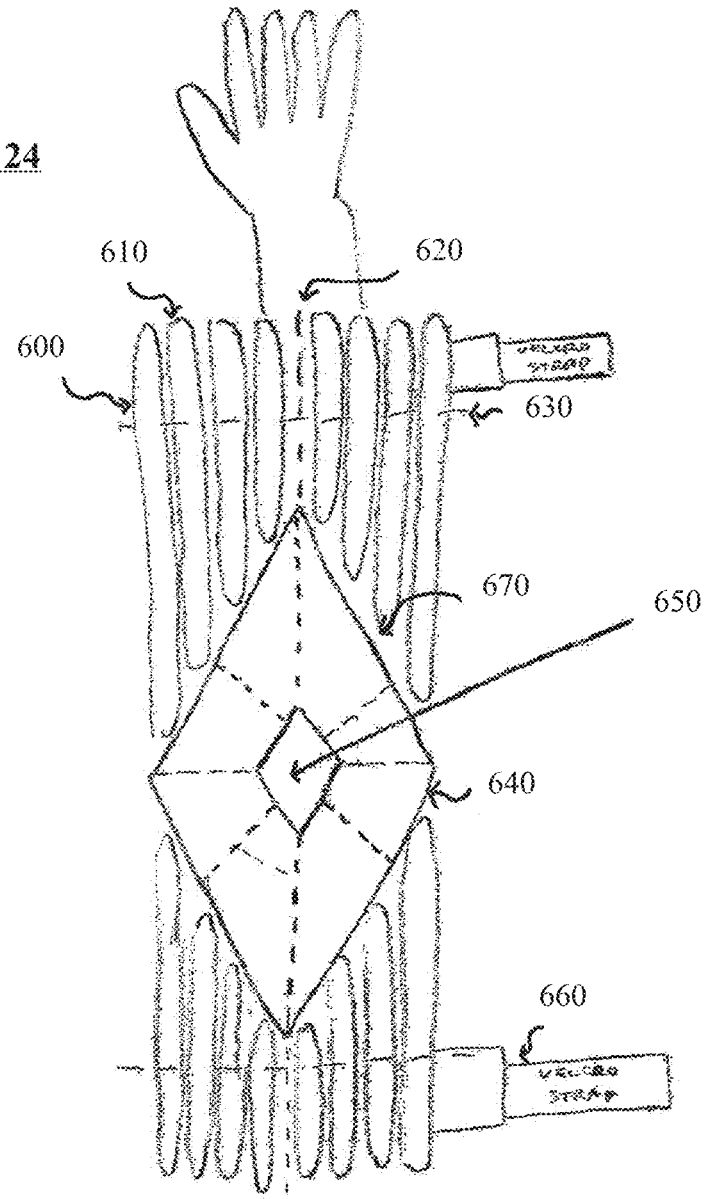
FIG. 24 is an upper view illustrating a preferred elbow pad embodiment of the gas chamber bladder personal protective padding system.

FIG. 24 is an exemplary drawing showing a representative configuration of the stabilization bladder of the personal protection padding system that is configured and adapted to be applied over an arm as an elbow pad 6. The stabilization bladder is comprised of a series of tubular shaped compartments or containers that are preferably filled with gas. One set of containers 610 is positioned between the user's hand and elbow, and another set of tubular shaped containers (not numbered) are positioned between the user's elbow and shoulder. As shown the two sets have individual fill/check valves, and the containers in each set are in fluid communication with each other. While the containers in the two sets are shown as closed-end tubes, the containers can be a plurality of compartments in any geometric, non-geometric or Euclidian shape, depending on their end use. Preferably they are filled with a gas 610 that is at a pressure above atmospheric pressure, and the pressure used is depending on the intended end use. A third set of containers is also shown in FIG. 24, positioned between the first and second sets of tubular sets of compartments. The third set of containers may be made so as to have separate fill/check valving or may be made to be in communication with either the first or second set of containers. As shown in FIG. 24, a preferred shape of the gas compartments adjacent the hand and the should is a closed-ended tube, and the preferred shape of the gas compartments directly over the joint is that of a polyhedron, specifically, having parallelogram cross-sections. Of course the length, diameter, width, and size of the gas compartments or bladders can vary according to the specific end use.

In the FIG. 24 embodiment the tubular compartments run parallel to one another The stabilization bladder 12 formed by the gas compartments is provided with seams, also referred to as flex points or lines, one set of which is shown as dashed lines at 630 and another set of seams or flex lines shown but not numbered. The alignment of the gas compartments and the seams in relation to each other enable the personal protection padding system to wrap around, or partially wrap around the elbow joint and adjacent lower and upper arms of the user.

The gas compartments are comprised of one or more layers of a material capable of incurring significant impacts without rupturing, preferably including, but not limited to plastics, carbon fibers, thermoplastics, polyethylene terephthalate, polystyrene, polyvinyl chloride, polytetrafluoroethylene, polyvinylidene chloride, polyethaline, low-density polyethylene, high-density polyethylene or polypropylene. The gas compartments are of differing lengths, wherein the lengths of the individual containers of the first set preferably mirror those of the second set along both the longitudinal and horizontal axes 620. As shown in FIG. 24 the bladder for the joint protection padding system is adapted for elbow protection and includes a first set of gas compartments (not numbered) positioned between the user's hand and elbow, and a second set of gas compartments (not numbered) positioned between the user's elbow and shoulder. The ends of the first and second sets of gas compartments near the elbow are adjacent the third set of gas compartments, referred to as the joint stabilization set or bladder (640). The first and second sets of gas compartments terminate at ends (670). In use the third set, the stabilization bladder 640, is positioned over and fully encompasses the joint being protected, which in this embodiment is the elbow. The stabilization bladder 640 is comprised of a plurality of gas compartments in any geometric, non-geometric or Euclidian shape, filled with a gas. Each of the gas compartments in the outer periphery of the FIG. 24 embodiment bladder or bladder section is generally of a polyhedron shape. As also shown in FIG. 24, a series of dashed lines represent seams or flex lines about which the stabilization bladder 640 outer periphery gas compartments can wrap around the elbow joint itself. The stabilization bladder 640 preferably has a center gas compartment adapted to be positioned directly over the fulcrum of the elbow, or other joint in other embodiments, during use. The center gas compartment shown in FIG. 24 is a polyhedron having a parallelogram cross-section. The peripheral stabilization gas compartments are connected to the center gas compartment 650 and each of them is a polyhedron with a four-sided cross-section, i.e., a trapezoid in this embodiment. Each of the gas compartments of elbow stabilization bladder section is preferably comprised of one or more layers of a material capable of incurring significant impacts without rupturing including, but not limited to plastics, carbon fibers, thermoplastics, polyethylene terephthalate, polystyrene, polyvinyl chloride, polytetrafluoroethylene, polyvinylidene chloride, polyethaline, low-density polyethylene, high-density polyethylene or polypropylene. The most preferable material of construction for all of the bladder sections for all the embodiments described herein is a 7-layer or 9-layer thermoplastic film commercially available from Air-Paq, Inc., China.

The joint stabilization bladder section allows full mobility of the joint being protected by allowing the joint pad system to freely move with the user, while reducing the impact of any blow to the joint or bone(s) being protected. The joining of the several gas compartment section in any of various configurations, depending upon the shape(s) and/or configuration(s) adapted for any predetermined joint and/or bone(s) being protected, and with or without an outer, protective shield, forms a combination referred to as the joint protection padding system. For example, the present system can be shaped and sized to protect elbows, knees, knuckles, shoulders and hips.

Embodiments of the joint protection padding system can be attached to an individual or to an animal using conventional fastening devices, such as a series of hook-and-loop fasteners (e.g. VELCRO® brand fasteners) 660, straps, elastic bands; or made part of a user's uniform or clothing; or inserted into pockets fashioned into a user's uniform or clothing or protective equipment.

Figure 25:
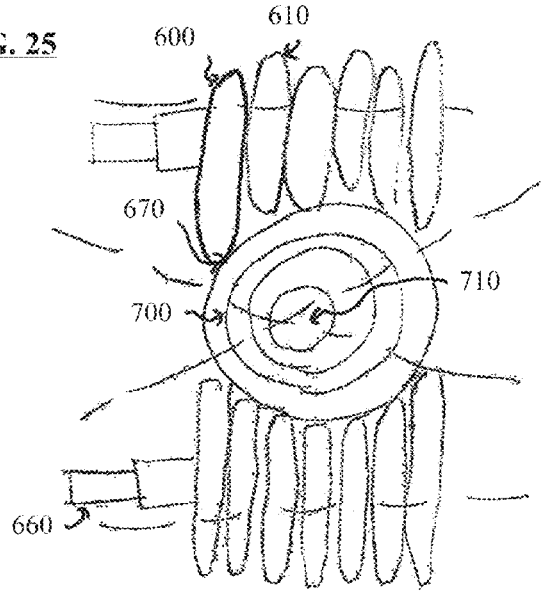
FIG. 25 is an upper view illustrating an alternate preferred gas chamber bladder embodiment of the personal protective padding system.

The stabilization bladder illustrated in FIG. 25 is comprised of three sections of gas compartments, arranged as a series of concentric circles 7 surrounding a center gas compartment circle 710, and upper and lower sets of tubular gas compartments. Seams as shown as dashed lines to indicate flex lines positioned in the upper and lower sections, and between each adjacent circle in the third, or knee joint stabilization section. These gas compartments in all three sections are comprised of the same materials as described above in regard to the FIG. 24 embodiment. Fill/check valves 660 are shown connected to the upper and lower sets of compartments. The gas compartments in the third or center section may be in fluid communication with either of the upper or lower sections, or may be made to have its own fill/check valve.

Figure 26:
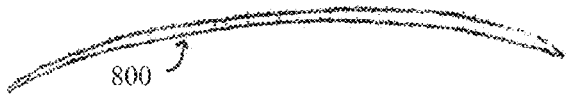
FIG. 26 illustrates one preferred embodiment of shielding for the personal protective padding system.
Figure 27:
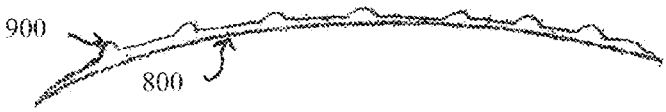
FIG. 27 illustrates an alternated preferred shielding embodiment for the personal protective padding system illustrating upper ridges for enhanced strength; and, FIG. 28 illustrates an alternate preferred shielding embodiment for the personal protective padding system illustrating both upper and lower ridges for enhanced strength.
Figure 28:
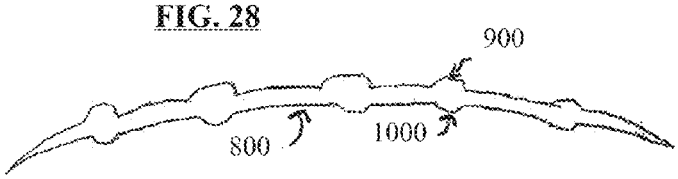

The various embodiments of the joint protection padding system bladders may be covered by a shield to protect the exterior portion of the system and the user. FIG. 26 is the side cut-out view of one configuration of shielding in which a flat protective surface 8 is adapted to slide over or encase the sets of gas compartments 30 of the personal protection padding system. FIG. 27 is the side cut-out view of an alternate configuration of the shielding in which a series of ridges on the exterior portion of the shielding 9 which is adapted to slide over or encase a stabilization bladder or sets of bladders of the personal protection padding system. FIG. 28 is the side cut-out view of an alternate embodiment of the shielding in which a series of ridges are formed on both the exterior and interior of the shielding 10 and which is adapted to slide over or encase a bladder or sets of bladders of the joint protection padding system. The specific configuration of the shielding depends upon the intended use of the personal protection padding system.

Bladder-Suspension Hybrid Protection Systems

Referring to FIGS. 29A-34B, additional embodiments of the present protective systems adapted for joint protection will be described. The FIGS. 29A-34B embodiments are hybrid protection systems in that they combine the bladder type protection systems with the suspension systems.

Figures 29A, 29B, 29C, 29D:
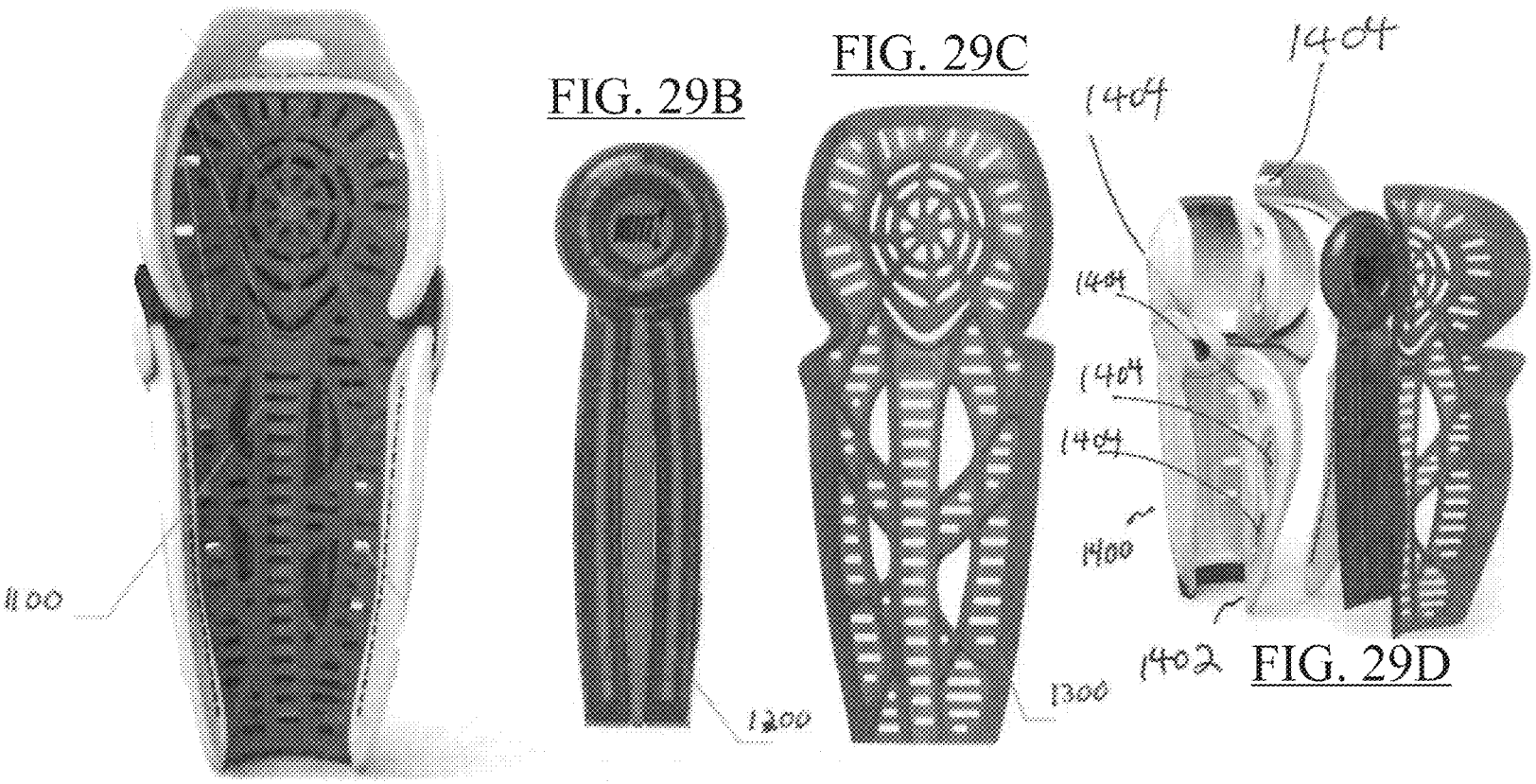
FIG. 29A illustrates an alternate preferred embodiment of a hybrid personal protective padding system adapted for knee joint and shin protection.
FIG. 29B illustrates the gas compartment bladder of the FIG. 29A embodiment.
FIG. 29C illustrates the flexible substrate of the FIG. 29A embodiment.
FIG. 29D is an exploded view of the FIG. 29A embodiment.

FIG. 29A illustrates the configuration of the personal protective padding system as configured to protect the knee and shin by use of a hard outer shell 14 in conjunction with a stabilization bladder 12 and the flexible substrate 13. The stabilization bladder 12 has an adjustable pressure for a personalized protection level, depending on the application. The flexible substrate 13 provides direct flow ventilation, asymmetrical support to the supported bone and is antimicrobial and hydrophobic with a non-slip texture. The flexible substrate 13 can be engineered to provide dynamic polymeric suspension for variable tension levels for specific tasks; strategic flexion and elongation for joint articulations; structural bridges for designated high tensile zones; and vents for moisture management and weight reduction. The FIGS. 29A-34B hybrid knee and shin personal protective systems preferably include a hard outer shell or shield, a stabilization bladder comprised of individual gas compartments and a flexible suspension web or substrate. The outer shell or shield can be unitary, or formed from two pieces, as shone in FIG. 29D as 14, 1402. Preferably the sides of the shield include a plurality of ventilation holes, shown for example at 1404 in FIG. 29D. The individual gas compartments are fashioned to form the stabilization bladder that preferably fully encompasses the exterior of the knee joint and adjacent shin bone(s). The flexible suspension web is a flexible substrate that is positioned against the user. The stabilization bladder is positioned entirely or partially between the flexible substrate and the shell. Preferably the suspension web is sized and contoured to fit over the patella, includes a laminated, moisture wicking antimicrobial liner and different regions of the web have different tensile strengths, dimensions and/or shapes to accommodate the expected different levels of force that will be applied to different regions of the web. The air gaps in the web also provide for ventilation. The sides 1402 of the shield or shell 14 are preferably made of high density polyethylene for protection against stick slash and puck impact. The sides 1402 of shield 14 may be unitary with the shield front or may be made as separate inserts as shown in FIG. 29D.

Figure 30:
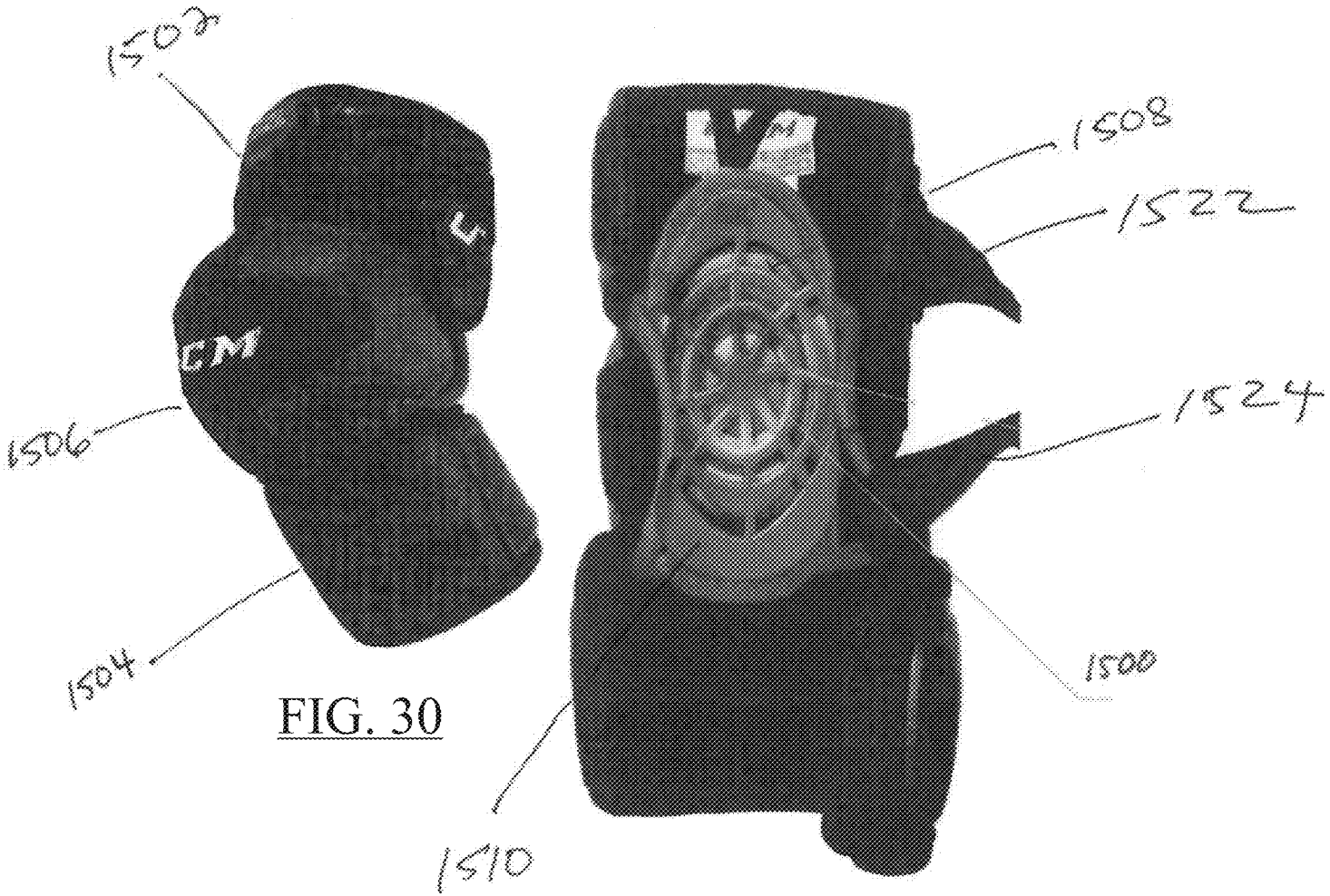
FIG. 30 illustrates an alternate preferred embodiment of the hybrid personal protective padding system adapted for the elbow joint.

Referring to FIG. 30, an alternate embodiment of the hybrid bladder suspension protection system has been adapted to function as an elbow pad 15, which includes outer upper, outer lower and outer center shield members 1502, 1504 and 1506, respectively, a stabilization bladder 1508 and a suspension web 1510. The bladder 1508 is positioned between the web 1510 and the center shield member 1506. The suspension web is sized and contoured to cradle the elbow, and is adapted to prevent the elbow from bottoming out against the center shield member 1506, thus reducing the risk of bone chips and cartilage damage.

Figure 31:
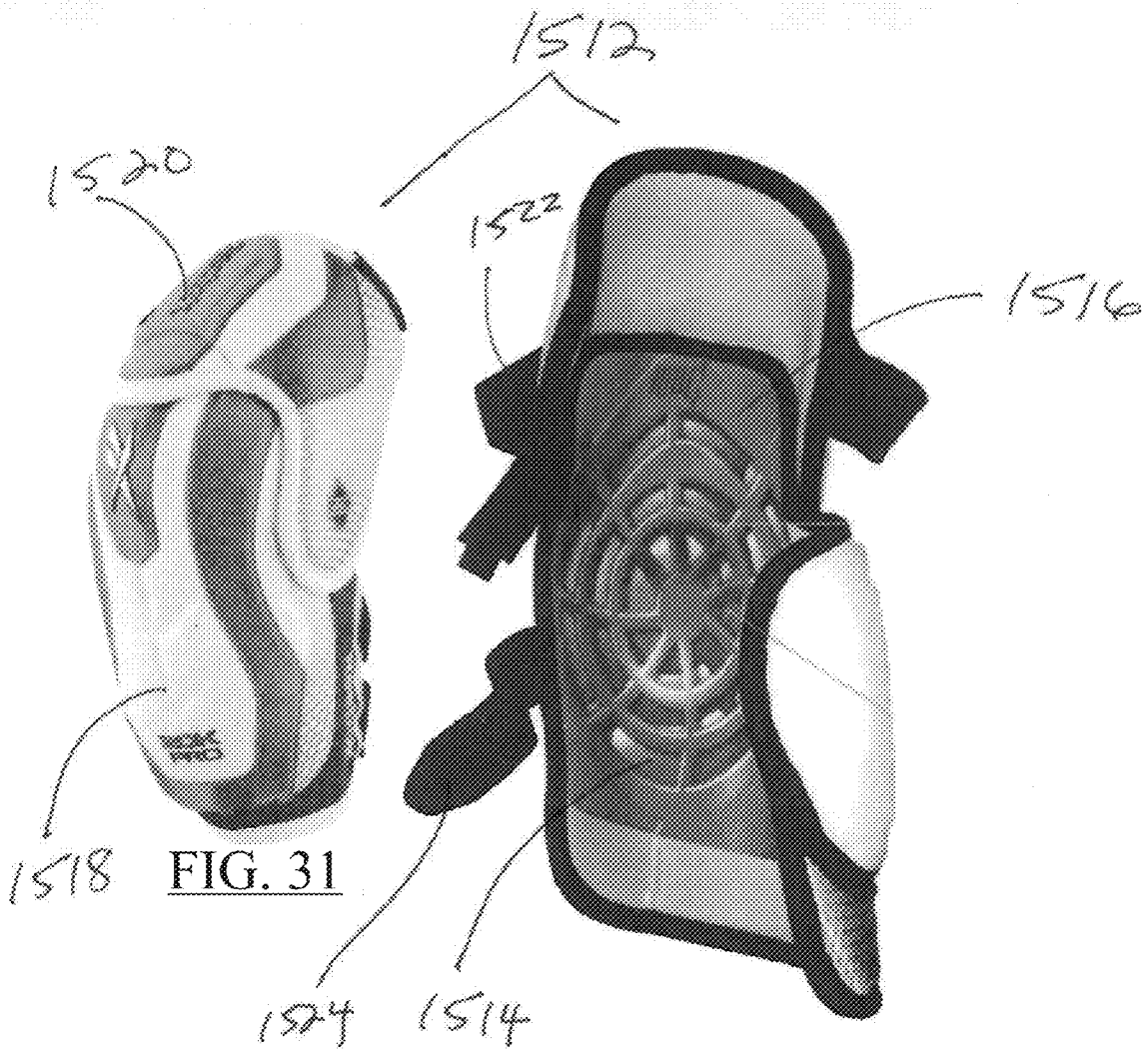
FIG. 31 illustrates an alternate preferred hybrid elbow protection embodiment of the personal protective padding system.

Referring to FIG. 31, an alternate elbow pad 1512 is shown. The FIG. 31 elbow pad 1512 also includes a stabilization bladder 1514 and a suspension web 1516, but has two shield members 1518 and 1520 rather than three shield members as in the FIG. 30 embodiment. In FIG. 31, the bladder 1514 and suspension web 1516 extend over part of the lower shield member 1518 and over part of the upper shield member 1520. As shown in FIGS. 30-31, two straps 1522, 1524 are used to removably fasten the elbow pad to the elbow.

Figure 32:
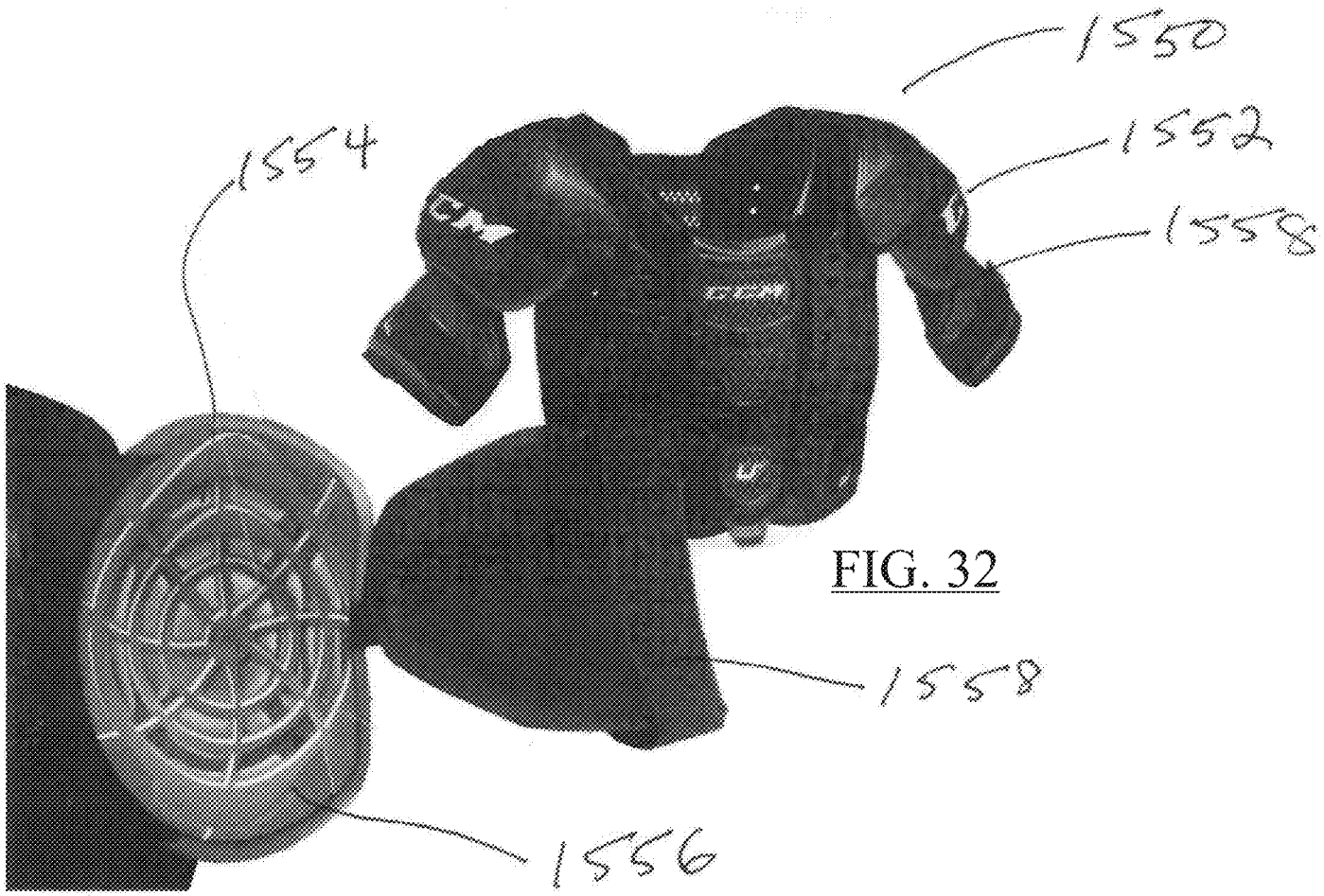
FIG. 32 illustrates a preferred hybrid shoulder joint and chest protection embodiment of the personal protective padding system.

Referring to FIG. 32, a shoulder and upper chest padding system 1550 is shown. The protective padding system 1550 is shown in the form of a shoulder and upper chest pad. The pad 1550 installed over the exterior of the shoulders, covering the anterior, posterior and lateral portions of the shoulder. The shoulder pad 1550 includes outer shield 1552, stabilization bladder 1554 and suspension web 1556. The pad 1550 is connected to arm band 1558 which is adapted to be removably fastened to the arm of the user.

Figure 33A:
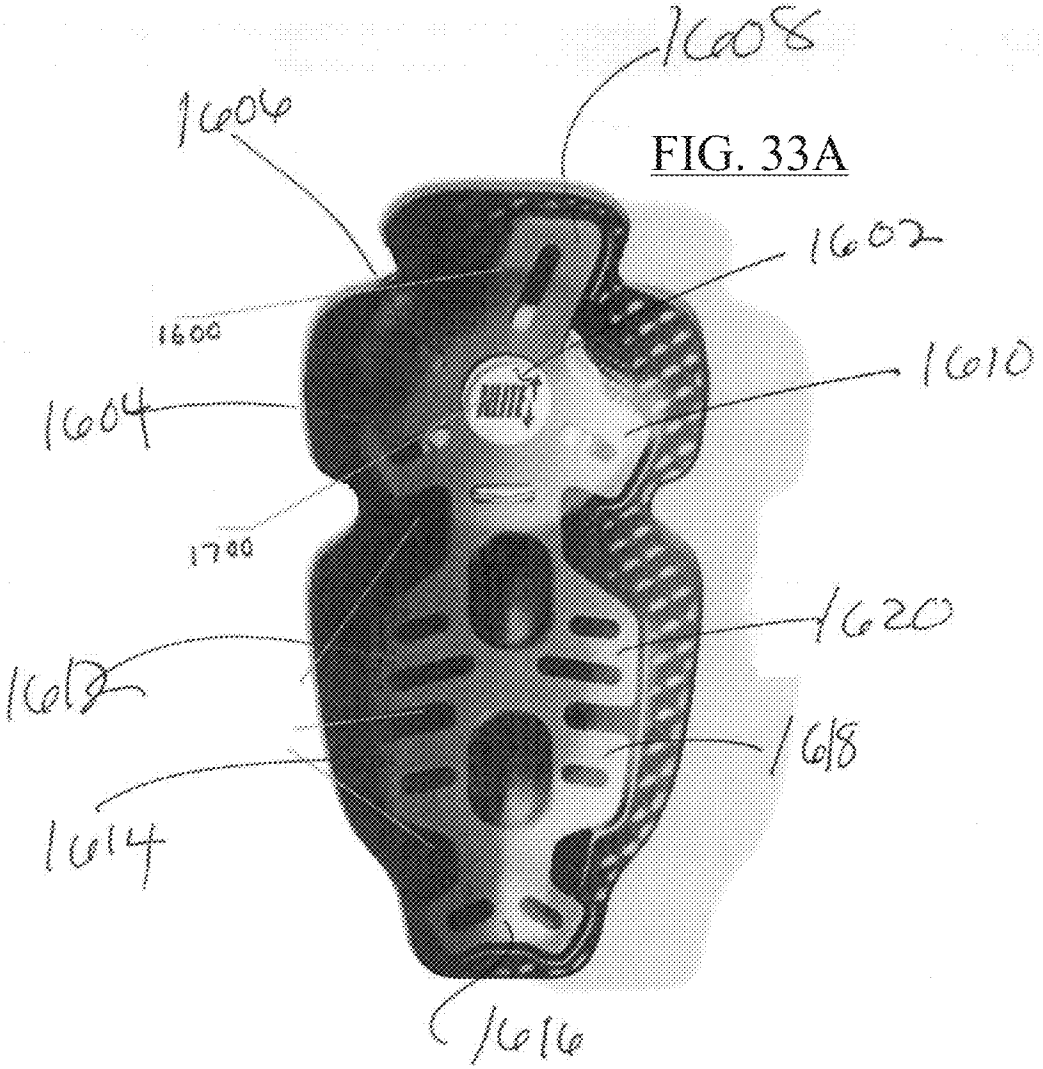
FIG. 33A illustrates an alternate preferred hybrid knee and shin protection embodiment of the flexible substrate.
Figure 33D:
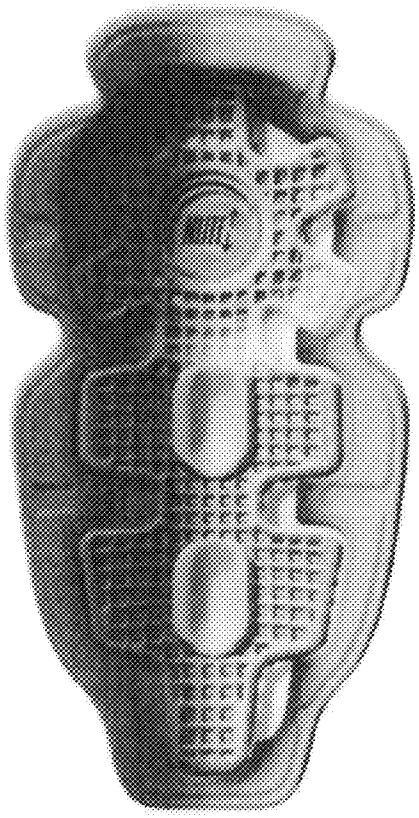
FIG. 33*d* illustrates an alternate preferred hybrid knee and shin protection embodiment of the flexible substrate.
Figure 33C:
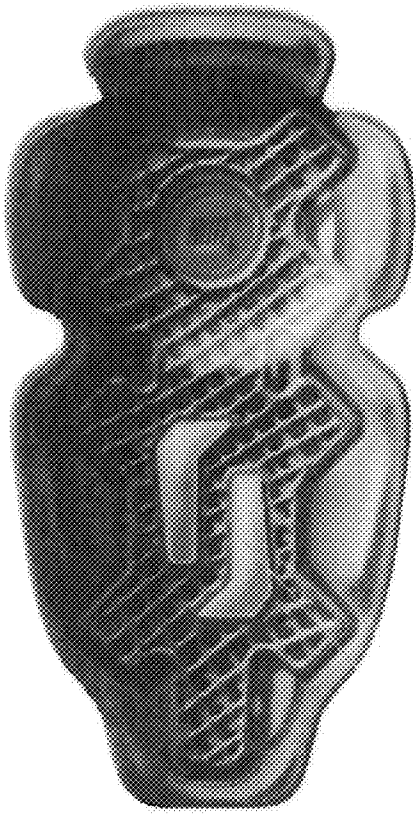
FIG. 33C illustrates an alternate preferred hybrid knee and shin protection embodiment of the flexible substrate.
Figure 33B:
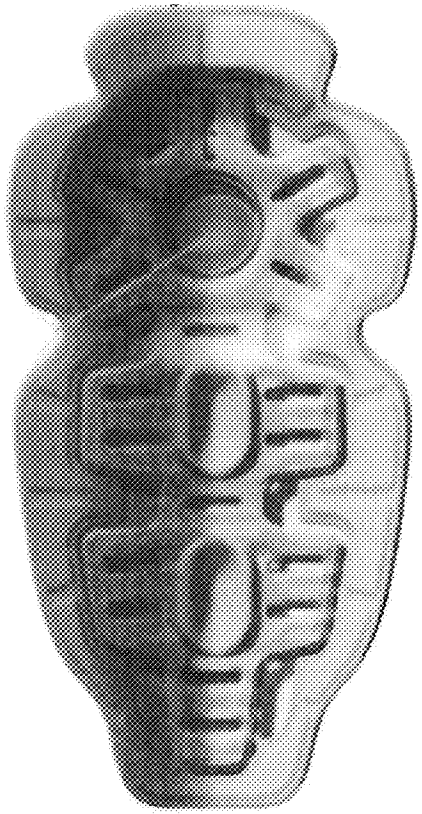
FIG. 33B illustrates an alternate preferred hybrid knee and shin protection embodiment of the flexible substrate.

Referring to FIGS. 33A-33D, several alternate embodiment knee and shin pads are shown. All these embodiments include the basis bladder-suspension protective systems and an outer shield. The various embodiments of FIGS. 33A-33D generally have the same outer shell configuration, but have variously configured bladder and suspension structures. For example the FIG. 33*a* embodiment suspension web 16 has a top section that includes a generally round, center hole 1602, and four, asymmetrical wings 1604, 1606, 1608 and 1610 that radiate outward from the center. The stabilization bladder 17 is generally circular and is positioned in the upper, center part of the knee and shin pad, over the patella during use. The lower part of the knee and shin pad includes a generally elongated suspension web with five wings 1612, 1614, 1616, 1618 and 1620. All of the upper and lower wings 1604-1620 have ventilation holes, unnumbered, that are generally of an elongated oval shape. Additional ventilation holes are placed in the center regions of the suspension web 16. FIGS. 33B-33D illustrate various alternate configurations for the bladders and suspension webs. For example, it may be seen that the FIG. 33*d* embodiment has a relatively high number of air or ventilation gaps compared to the FIG. 33B embodiment. Also, the number and configuration of the suspension wings in the FIG. 33C embodiment are significantly different from those of FIG. 33B.

Figure 34:
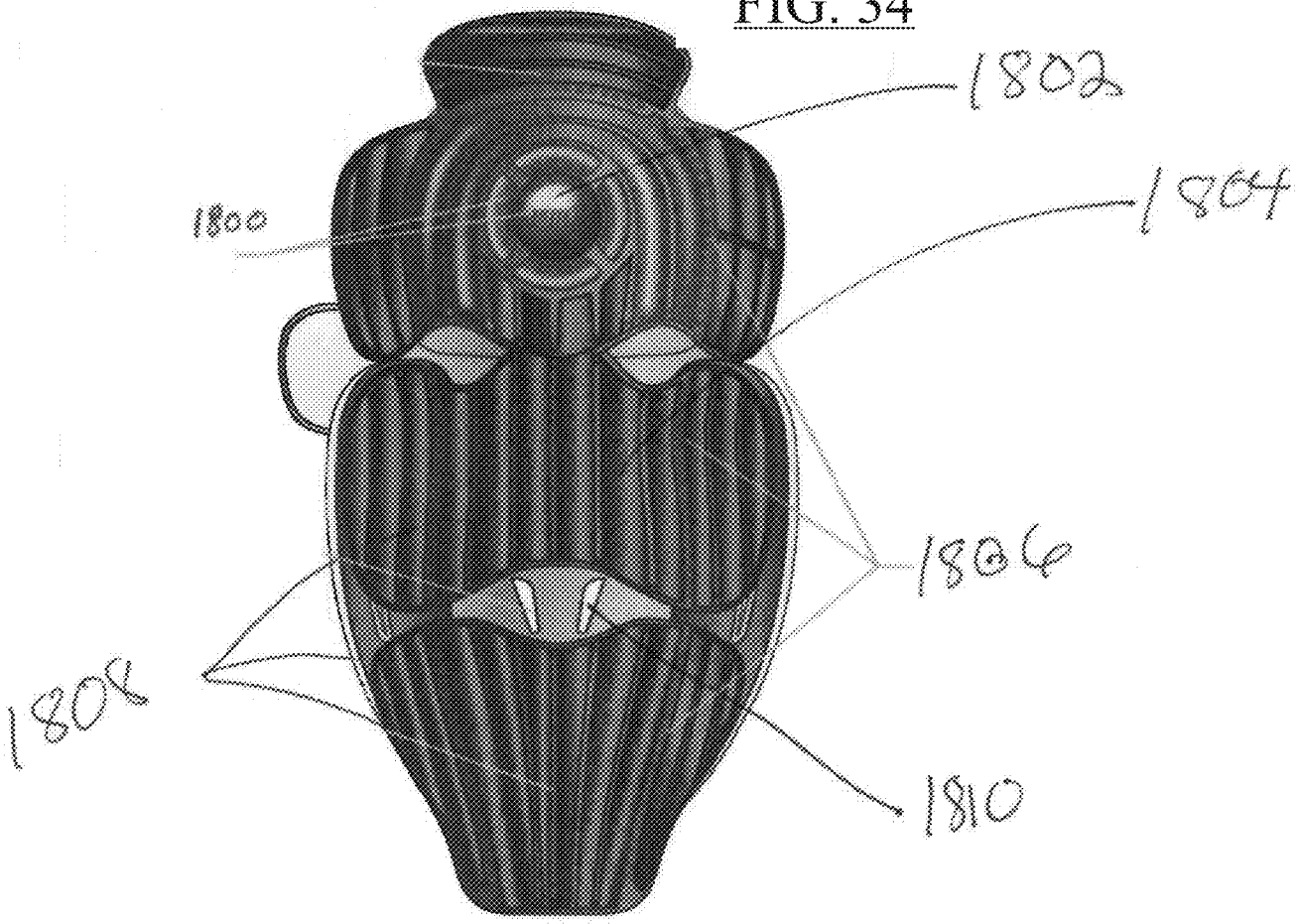
FIG. 34 illustrates an alternate preferred hybrid knee and shin protection embodiment of the gas compartment bladder system.
Figure 35B:
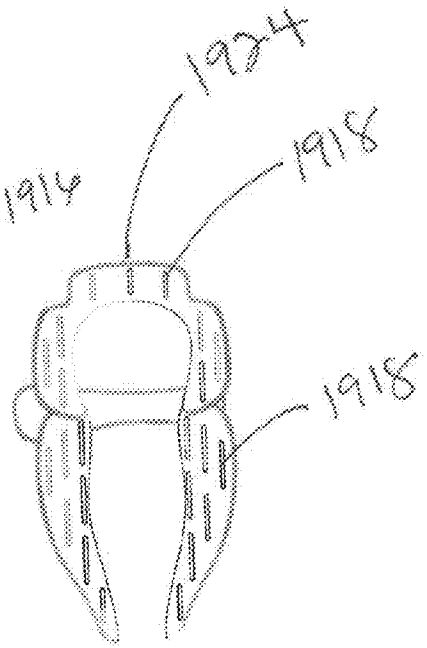
FIG. 35B is an exploded, rear view of the central, shield and peripheral shield members of the FIG. 35A embodiment.
Figure 35A:
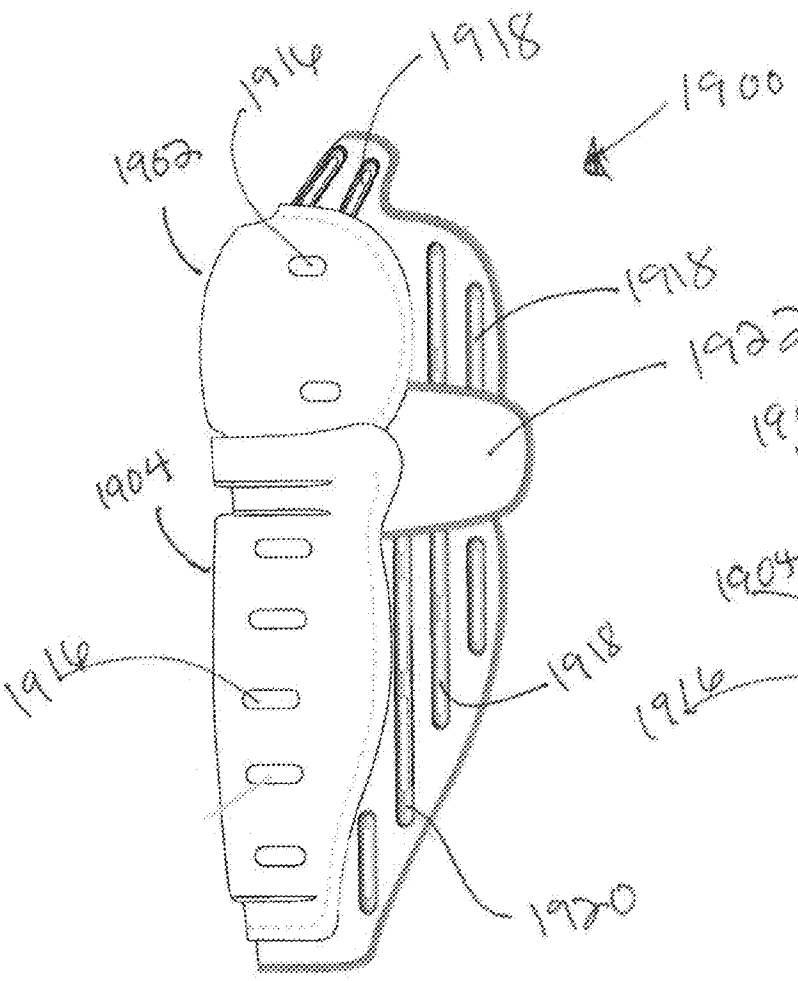
FIG. 35A is a side view of an alternate preferred hybrid knee and shin protection embodiment.
Figure 35C:
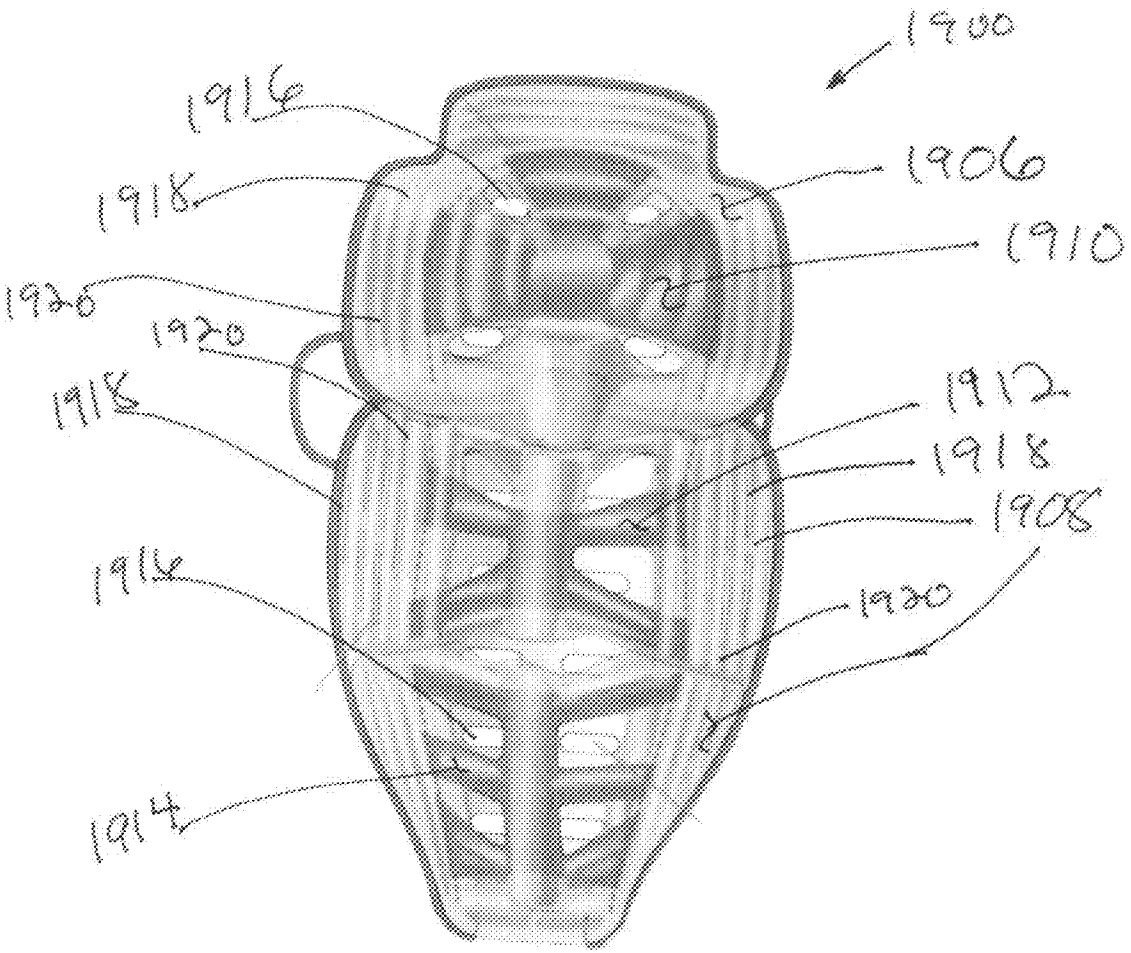
FIG. 35C is a rear view of the FIG. 35A embodiment.
Figure 35E:
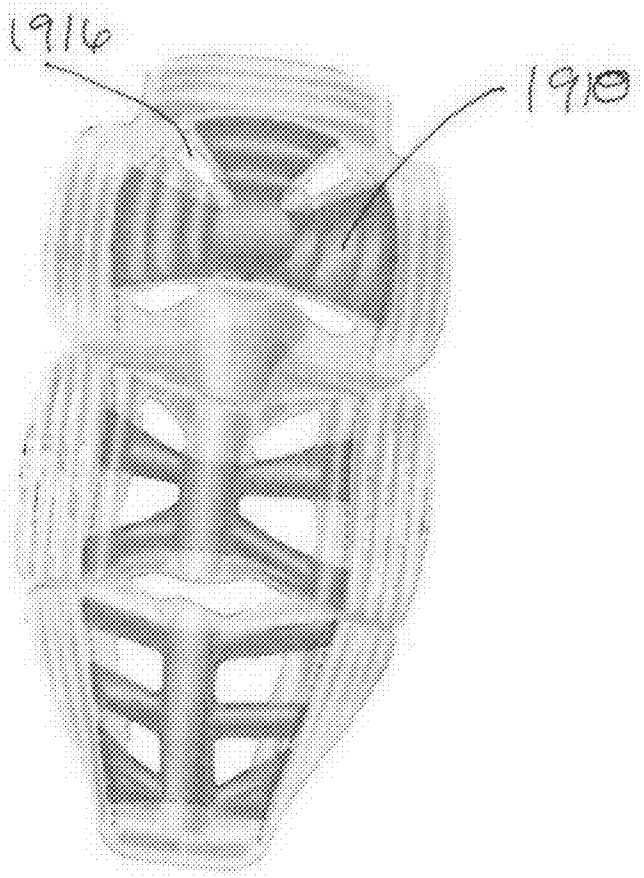
FIG. 35E is a partial, rear view of the suspension web and the bladder of the FIG. 35A embodiment.
Figure 35D:
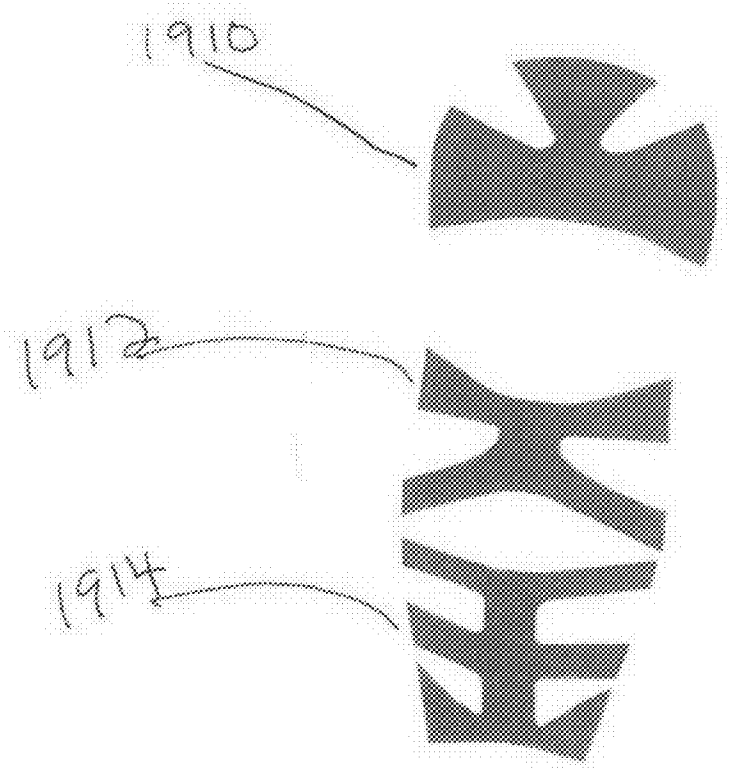
FIG. 35D is a schematic, front view of the suspension web of the FIG. 35A embodiment.

Referring to FIG. 34 an additional alternate embodiment knee-shin guard or pad is shown. Guard 18 includes a bladder 1802 in the center of the upper section, positioned directly over the patella during use. The suspension web 1804 includes a series of bladders that form an independent suspension system, including a removable center section that can be removed at seam 1806 with conventional means, such as a zipper to provide for removal, washing, replacement and/or customization. The web 1804 is also configured to have a plurality of grooves or channels 1808 that generally run or extend from top to bottom during use. These channels function primarily as moisture management channels and also provide for ventilation. Holes or channels 1810 extending through the guard and provide for direct ventilation from the user's body to ambient. The number, size and shape of the holes can vary. Preferably the shell or shield of the guard 18 is HDPE reinforced EVA, and the suspension layer includes an antimicrobial hydrophobic coating.

Referring to FIGS. 35A-35E, another alternate hybrid knee and shin guard 19 is shown. The guard includes a central 2-piece, overlapping shield 1902, 1904 and a peripheral shield member 1924. The guard 19 also includes a generally annular upper bladder section 1906, a generally elongated, annular lower bladder section 1908 and a 3-part suspension section 1910, 1912, and 1914. A plurality of direct flow ventilation holes 1916 extend through aligned holes positioned in the shield, in the bladder and open spaces in the suspension web. A plurality of relatively small vents 1918 are positioned in seams or flex channels 1920 of the bladder sections 1906, 1908 and are aligned with vents or holes, shown in an elongated slot configuration 1918 in the peripheral shield member 1924. One or more straps 1922 function to removably retain the guard on the user.

The 2-piece, overlapping shield preferably includes a center section 1904 and a peripheral section 1902. The center section 1904 has a generally circular upper part covering the knee during use and a relatively long, oblong shaped part that covers the shin during use. The peripheral section 1902 of the shield is flexibly attached to and extends around the outer periphery of the center shield section. The upper and lower parts of the shield center section 1904 are flexibly joined by conventional means. Both the upper and lower parts of the shield center section 1904, and the peripheral section of the shield preferably include a plurality of holes that function to provide direct ventilation during use. The number, size, shape and position of the holes can vary. The shields are made of a relatively hard material, preferably HDPE reinforced EVA.

The 3-part suspension section top part 1910 is shown as a sling having left, top and right wings that extend radially outward from a center and are anchored to the shield. The center part 1912 is shown as a sling having left lower, left upper, right upper and right lower wings extending from a center part radially outward to and anchored to the shield. The lower part 1914 is shown as a sling with left lower, left center, left top, right top, right center and right lower wings extending outward from a central rib or member to the shield periphery and anchored to the shield. Each of the three suspension sections are made of a elastomeric polymer that has a limited range of stretching such that it will not impact the shield upon impact during use.

The bladder sections are preferably position between the shield sections and the suspension sections and include areas directly under part of the suspension sections as well areas that are the only cushioning material between the shield sections and the user. The bladder sections generally are of an elongated, tubular shape with a plurality of channels (not numbered) and a plurality of relatively small elongated ventilation holes 1918. The channels and elongated vent holes are seams in the bladder sections and also function to provide flexibility for the knee and shin guard 19. The suspension sections may optionally be detachable, as described in regard to the FIG. 34*a* embodiment.

Protective suspension systems are often used to prevent or mitigate injury to major skeletal, muscular and nervous systems contained in the shoulder area, including the sub-deltoid bursa, capsular ligaments, acromion, head of humerus, head of humerus, deltoid muscle, brachial plexus, head of the radial nerve and musculotaneous nerves. In the event of a fall onto the shoulder, or in the event of a projectile object striking the protected portion of the shoulder, the personal protective padding systems is intended to dampen, deflect and or disburse the energy transmission from the encountered fall surface or projectile object, mitigating damage to the underlying musculoskeletal structure or nerves.

The elbow personal protective padding systems are adapted to be installed over the posterior portion of human elbow, wrapping to cover the medial and lateral portions of the elbow, protective suspension systems are often used to prevent or mitigate injury to major skeletal, muscular and nervous systems contained in the elbow area, including the lateral epicondyle, medial epicondyle, trochlea, condyles, head of the ulna and radius. In the event of a fall onto the elbow, or in the event of a projectile object striking the protected portion of the elbow, the personal protective padding systems is intended to disburse the energy transmission from the encountered fall surface or projectile object, mitigating damage to the underlying musculoskeletal structure or nerves.

The knee personal protective padding systems are adapted to be installed over the posterior portion of human knees, wrapping to cover the medial and lateral portions of the knees. Protective suspension systems are often used to prevent or mitigate injury to major skeletal, muscular and nervous systems contained in the knee area, including the head of the tibia, head of the fibula, fibular collateral ligament, iliotibial tract, patellar ligament, common peroneal nerve, tibial nerve, peroneal communicating branch. In the event of a fall onto the elbow, or in the event of a projectile object striking the protected portion of the elbow, the personal protective padding systems is intended to disburse the energy transmission from the encountered fall surface or projectile object, mitigating damage to the underlying musculoskeletal structure or nerves.

Personal protective padding systems of the present invention may also be fashioned to be installed over the area of the human iliac crest. Protective suspension systems are often used to prevent or mitigate injury to major skeletal, muscular and nervous systems contained in the area of the iliac crest, including greater trochanter, illiac crest, and head of the femur, gluteus medius and gluteus minimum muscles, tensor fasciae latae muscle, iliotibial band. In the event of a sideways fall onto the protected portion of the iliac crest, the personal protective padding systems is intended to disburse the energy transmission from the encountered fall surface, or from a projectile object, thereby mitigating damage to the underlying musculoskeletal structure or nerves.

The shin personal protective padding systems of the present invention are adapted to be installed over the anterior portion of the lower leg, commonly referred to as the shin. Protective suspension systems are often used to prevent or mitigate injury to the musculoskeletal systems contained in the shin area, specifically fractures or bruising to the tibia or fibula, or disruption to the interosseous membrane or related nerves and blood vessels. In the event of the protected area encountering extreme force, the personal protective padding systems is intended to disburse the energy transmission from the encountered force, thereby mitigating damage to the underlying musculoskeletal structure or nerves. The shin personal protective padding systems preferably are combined with a knee protection system and formed as a single accessory of piece of equipment.

The personal protective forearm padding systems of the present invention are adapted to be installed over the posterior, medial and lateral portions of the lower arm, commonly referred to as the forearm. Protective suspension systems are often used to prevent or mitigate injury to the musculoskeletal systems contained in the forearm area, specifically fractures or bruising to the radius or ulna, or disruption to the interosseous membrane, and oblique cord. In the event of the protected area encountering extreme force, the injury protection pad is intended to disburse the energy transmission from the encountered force, thereby mitigating damage to the underlying musculoskeletal structure or nerves. The personal protective padding systems over the lower arm preferably are in conjunction with those over the elbow.

It should be noted that, while not shown, personal protective padding systems of any size or configuration may reasonably be positioned over any anatomical portion of the human body, thereby preventing or mitigating injury to the human body by damping, deflecting, dispersing energy created when a portion of the human body in motion encounters a stationary or slower moving object, of then a projectile object encounters the human body. The disclosure of personal protective padding systems herein shall not be limiting either in location, size or other forms of definition.

The stabilization bladders are customizable in that they can be inflated or filled to different degrees of pressure which is chosen by the user to allow for a personalized level of protection, depending on the application. The stabilization bladders allow essentially full mobility of the joint or bone being protected by allowing the joint protection padding system to freely move with the user's joint and adjacent bones and muscle, while reducing the impact of any blow to the joint or bone(s) and muscle(s) being protected. The gas compartments and valving combine to form a joint stabilization bladder, and the bladder, shield and/or the suspension webs combine to form the joint protection padding system. The stabilization bladder can also be removed or deflated for use during lighter-impact activities.

Embodiments of the personal protective padding system can be attached to an individual or to an animal using conventional fastening devices, such as a series of hook-and loop fasteners (e.g. VELCRO® brand fasteners), straps, elastic bands; or made part of a user's uniform or clothing; or inserted into pockets fashioned into a user's uniform or clothing or protective equipment.

The specific configuration of the shielding depends upon the intended use of the personal protective padding system. Embodiments of the personal protective padding system may be worn externally or internally within the clothing or protective equipment of an individual to protect specific portions of the individual's body, specifically joints, as described above. The personal protective padding system preferably provided with vent holes or channels that function to ventilate and to allow for breathability. The interior side of the joint protection padding system can be covered in various materials, including but not limited to conventional fabrics capable of breathing, i.e., "wicking" sweat away, in order to increase the rate at which sweat dissipates from the area being protected.

Embodiments of the personal protective padding system may be adapted for use on humans or animals after surgery or after injury not requiring surgery, to protect the affected area. Embodiments of the personal protective padding system can also be used for rehabilitation, bracing and support of the area being protected. Although specific embodiments of the inventions have been described, various modifications, alterations, alternative constructions, and equivalents are also encompassed within the scope of these inventions. The specification and figures are, accordingly, to be regarded in an illustrative rather than a restrictive sense. It will, however, be evident that additions, subtractions, deletions, and other modifications and changes may be made thereunto without departing from the broader spirit and scope of the inventions as set forth in the claims.

What is claimed is:

1. A personal protective padding system for protection of a user from blunt force impact to a corresponding joint of the user's body, the padding system comprising:

a first and a second outer shield member, each outer shield member having a front face and a rear face, the first and second outer shield members movably fastened together so as to reduce limiting movement of the user's body parts adjacent to each side of the joint to which the system is applied;

a plurality of inflated gas compartments, a first set positioned adjacent the rear face of the first outer shield member and a second set positioned adjacent the rear face of the second outer shield member, each set of gas compartments configured to absorb and diffuse impact energy when the system is applied to a corresponding joint, each set of the gas compartments comprising a multi-layered, coextruded polyethylene film, the film comprising reinforcing strands incorporated therein; and a flexible, polymeric web extending across the rear face of the first outer shield member and positioned at a predetermined distance therefrom, whereby the web is configured to absorbs and diffuse impact energy when the system is applied to a corresponding joint.

2. The system of claim 1, wherein the reinforcing strands comprise nylon.

3. The system of claim 1, wherein it is configured to protect the user's knee joint.

4. The system of claim 1, wherein it is configured to protect the user's elbow joint.

5. The system of claim 1, further comprising a means for securing the system to a corresponding joint of the user's body.

* * * * *